US011708842B2

(12) United States Patent
Parmar et al.

(10) Patent No.: US 11,708,842 B2
(45) Date of Patent: Jul. 25, 2023

(54) SUBMERSIBLE WATER LIFTING ASSEMBLY AND AUTOMATIC FIRE FIGHTING SYSTEM FOR UNMANNED PLATFORMS HAVING SAID SYSTEM

(71) Applicants: Ukalal Devjibhai Parmar, Ahmedabad (IN); Dhruvil Umeshbhai Sagar, Ahmedabad (IN)

(72) Inventors: Ukalal Devjibhai Parmar, Ahmedabad (IN); Dhruvil Umeshbhai Sagar, Ahmedabad (IN)

( * ) Notice: Subject to any disclaimer, the term of this patent is extended or adjusted under 35 U.S.C. 154(b) by 160 days.

(21) Appl. No.: 17/055,480

(22) PCT Filed: May 13, 2019

(86) PCT No.: PCT/IN2019/050382
§ 371 (c)(1),
(2) Date: Nov. 13, 2020

(87) PCT Pub. No.: WO2019/220456
PCT Pub. Date: Nov. 21, 2019

(65) Prior Publication Data

US 2021/0222702 A1 Jul. 22, 2021

(30) Foreign Application Priority Data

May 17, 2018 (IN) ..... 201821018583
May 9, 2019 (IN) ..... 201922018627

(51) Int. Cl.
*F04D 29/42* (2006.01)
*F04F 5/46* (2006.01)
(Continued)

(52) U.S. Cl.
CPC ..... *F04D 29/426* (2013.01); *A62C 99/0009* (2013.01); *F04F 5/461* (2013.01); *F04D 29/708* (2013.01); *F04F 5/10* (2013.01)

(58) Field of Classification Search
CPC ..... A62C 3/07; A62C 3/31; A62C 99/0009; F04D 29/426; F04D 29/708; F04F 5/461; F04F 5/10
(Continued)

(56) References Cited

U.S. PATENT DOCUMENTS 1,610,454 A 12/1926 Lawaczeck
2,936,714 A 5/1960 Erich et al.
(Continued)

FOREIGN PATENT DOCUMENTS

CN 105650039 6/2016
CN 107255087 10/2017
(Continued)

OTHER PUBLICATIONS

International Search Report received in PCT/IN2019/050382, dated Aug. 19, 2019, 4 pages.
(Continued)

*Primary Examiner* — Steven J Ganey
(74) *Attorney, Agent, or Firm* — Klarquist Sparkman, LLP

(57) ABSTRACT

The technology relates to a submersible water lifting assembly and automatic fire fighting system for unmanned platforms having said system (1) that is efficient yet simple to install, energy saving, noise free and economical. The submersible water lifting assembly can comprise a High flow Ratio ejector Pump (30/30A) that utilizes under water arrangements of unmanned platform and enables the fire-fighting system to efficiently lift water from the sea water; using the force of existing water injection system; eliminating the requirement of diesel engine driven pump, for lifting the water. It avoids fire risk of the safety system itself, even in conditions of a large fire, unlike that of the prior art.

6 Claims, 10 Drawing Sheets

(51) Int. Cl.

| | |
|---|---|
| ***A62C 99/00*** | (2010.01) |
| *F04D 29/70* | (2006.01) |
| *F04F 5/10* | (2006.01) |

(58) Field of Classification Search
USPC ..... 169/13, 46, 47, 62, 69
See application file for complete search history.

(56) References Cited

U.S. PATENT DOCUMENTS

| | | | | |
|---|---|---|---|---|
| 3,815,682 | A * | 6/1974 | Chiasson | E21B 35/00 169/69 |
| 4,281,615 | A | 8/1981 | Wilson et al. | |
| 4,471,708 | A * | 9/1984 | Wilson | A62C 3/10 114/265 |
| 5,049,045 | A | 9/1991 | Oklejas et al. | |
| 5,199,848 | A | 4/1993 | Kapich | |
| 5,797,421 | A | 8/1998 | Merrett | |
| 10,870,474 | B2 * | 12/2020 | Hirst | B63H 25/42 |
| 2014/0299196 | A1 | 10/2014 | Heng et al. | |

FOREIGN PATENT DOCUMENTS

| | | |
|---|---|---|
| CN | 107806451 | 3/2018 |
| EP | 0322939 | 7/1989 |
| EP | 0539000 | 4/1993 |
| GB | 244 176 | 12/1925 |
| GB | 1378227 | 12/1974 |
| GB | 2061109 | 5/1981 |
| JP | S57 176396 | 10/1982 |
| JP | 2001037903 | 5/2000 |
| JP | 2009 250044 | 10/2009 |
| WO | WO 90/04700 | 5/1990 |

OTHER PUBLICATIONS

Written Opinion received in PCT/IN2019/050382, dated Aug. 19, 2019, 9 pages.
International Search Report received in PCT/IN2019/050381, dated Aug. 28, 2019, 5 pages.
Written Opinion received in PCT/IN2019/050381, dated Aug. 28, 2019, 11 pages.
First Technical Examination Report received in counterpart Danish Patent Application No. PA 2020-70832, dated Dec. 21, 2021, 6 pages.
Additional Search Report received in counterpart Danish Patent Application No. PA 2020-70832, dated Sep. 13, 2022, 1 page.
Examination Report received in counterpart India Application No. 201821018583, dated Aug. 27, 2020, 8 pages.
Examination Report received in counterpart India Application No. 201922018627, dated Dec. 21, 2021, 7 pages.
First Examination Report (w/English translation) received in counterpart Saudi Arabia Patent Application No. 520420547, 7 pages.
Examination Report received in counterpart United Kingdom Patent Application No. GB2019919.6, dated Feb. 21, 2022, 2 pages.
Certificate of Grant received in counterpart United Kingdom Patent Application No. GB2019919.6, dated Sep. 7, 2022, 1 page.

* cited by examiner

SUBMERSIBLE WATER LIFTING ASSEMBLY AND AUTOMATIC FIRE FIGHTING SYSTEM FOR UNMANNED PLATFORMS HAVING SAID SYSTEM

CROSS REFERENCE TO RELATED APPLICATIONS

This is the U.S. National Stage of International Application No. PCT/IN2019/050382, filed May 13, 2019, which was published in English under PCT Article 21(2), which in turn claims the benefit of India Application No. 201821018583, filed May 17, 2018, and India Application No. 201922018627, filed May 9, 2019, all of which are hereby incorporated herein by reference.

FIELD OF THE INVENTION

The present invention relates to a submersible water lifting assembly and automatic fire fighting system for unmanned platforms having said system. Particularly, the present invention relates to a submersible water lifting system for automatic firefighting at unmanned platform having said system, that is efficient yet simple to install, energy saving, noise free, and economical.

Present application is a divisional patent application to the invention disclosed in the provisional patent application number 201821018583 filed on 17 day of May 2018, providing a High Pressure Recovery Turbine Pump as said submersible water lifting assembly for energy efficient and economical part of the system that guarantees its working without diesel or electric power supply.

Present application provides an alternative submersible water lifting assembly for automatic firefighting system for unmanned platforms having said system. Said alternative submersible water lifting assembly for the present specification is a High flow Ratio ejector Pump that is efficient yet simple to install, energy saving, noise free, and economical; to be used in said automatic firefighting system.

BACKGROUND OF INVENTION AND THE PRIOR ART

The present disclosure specifically relate to the unmanned offshore platforms where processing of oil retrieved from earth is done. Said offshore platforms are located in the sea have marine structures known as platforms with various deck levels (say it, floors of building) to accommodate process plant for oil and gas separation (These are unlike manned platforms which accommodates living quarters for human being as well as process plant for oil and gas separation).

It is pertinent to note that the oil rich area, under earth surface (called Reservoir) is spread over large area in square kilometers. So, numbers of wells are required to be drilled over this area and offshore platforms are built on groups of such wells to maximize production of oil. Amongst said offshore platforms, one of the platforms is usually a processing platform; where the contents from all wells can be collected and processed under the supervision of men. Rest of the platforms work on automated mode and generally do not require continuous supervision and hence remain unmanned. All unmanned platforms are inter connected with said manned platform through subsea pipe lines (Subsea, generally at Sea bed level), like, well fluid lines, water injection lines, gas injection lines, etc. Wherein, said Water injection line is high pressure water line to inject water into wells for recovery of oil. Said unmanned platforms are occasionally visited by men for operational/maintenance jobs. Generally, it is remotely operated from manned platform.

Water injection systems are used for oil recovery extraction from oil reservoir (underground in the earth) by injecting high pressure water in some wells and extracting oil from other wells. This is called secondary oil recovery. The wells, in which, pressurized water is injected, are called water injection wells, whereas the wells, from which, oil extracted, are called Oil producing wells. Wells at sea bed; wherein pressurized water is injected in to the water wells to pressurize oil in the reservoir and to recover oil from the nearby oil wells, drilled by the drilling department of the oil and gas industry. The water has such high pressure that it limits the application to the above mentioned purpose and its risk to use for any other purposes at such pressure. The pressure is so high that it can damage material and men if it is used directly for firefighting purpose; and is manually difficult to control or at times is uncontrollable in given situation and with given resources.

Since Oil and natural gas are highly flammable, there is a high risk of fire associated with such platforms; which results in huge destruction and losses of assets and manpower. So the firefighting system has vital role in productivity by safeguarding assets & human lives. Existing firefighting systems generally uses one or more of the below technologies depending upon complexity of plant, means, nature of fire, types of area like open area or enclosed area etc.:

Dry Chemical Powder (DCP) system,
Halon/FM-200 system,
Foam Water Hose Reel (FWHR),
Fire Water Firefighting (FWFF) System,
CO2 stuffing System, and fire extinguishers.

But there are places in offshore platforms where compatible firefighting systems are either not available or if available then it is difficult to operate in automatic mode. Also, all existing systems are not compatible for unmanned platform at offshore, either by water flow quantity or by timely action to extinguish fire.

Moreover, while certain systems require maintenance at regular intervals; during which the platform is rendered disconnected with the firefighting system. Accidents leading to fire at this point may run the risk of complete destruction and human loss. Certain systems tend to chock and fail to operate when actually required; leading to the failure to serve the purpose. Additionally, manual operation or starting of firefighting system operation is not adequate at unmanned offshore platforms; as men do not reside there. Certain systems also fail to operate in open area while others fail to serve the purpose at closed areas. Their reliability for total, efficient and all types of fire extinction at Oil and Gas platforms is questionable.

Certain incidences have been recorded, when such platforms caught fire; due to gas leakage and the installed fire-fighting system did not work or support at that moment; leading to huge losses and emergency; calling for requirement of external help. At said platforms, which are far away from land; and between water on all the sides limited external help could be provided; when such incidences take place. With the available technology for this purpose; said external help includes firefighting ships that uses high power diesel based pumps to lift water to be poured on the fire caught areas or Army/Navy helicopters for transfer of manpower and strategic planning. Thus, existing systems were proven insufficient or inefficient to safeguard the offshore platforms when fire took place. This was specifically worst when the offshore platforms were unmanned platforms.

Major letdowns were due to failure of water-lifting system to start lifting water for fire-fighting system to work; wherein said water lifting systems were heavy and bulky fire engine and pump. This lifting system needs regular maintenance which is difficult at unmanned platform as man is not residing there. Alternative water lifting systems face problems of chocking with marine growth and failure of operations when in need. Thus, there is an unmet need to provide a water lifting system for automatic firefighting, in oil and gas industry to be used at said platforms; especially such systems that are feasible and useful at offshore platforms. Particularly, there is a need to provide such system that is efficient yet simple to install and economical.

Disadvantages of the Prior Arts

Existing water lifting system for automatic firefighting, suffer from at least one of the following disadvantages:

1. External aids such as ships and helicopter; which is expensive, at times not feasible and leads to huge losses by the time the external help is called and it reaches the platform.
2. The heavy diesel engine based pumps need regular maintenance which is difficult at unmanned platform as man is not residing there. This result in failure of its working; when actually required.
3. Existing water lifting systems face problems of chocking with marine growth and failure of operations when in need.
4. The existing water lifting system for firefighting, require complex, multi and costly installations; yet fails to ensure safety and efficiency.
5. Said bulky installations and its connection with the platform make up a complex system; difficult and risky to operate.
6. Said bulky installations require large space for installation; which is a concern on offshore platforms.
7. They require external energy sources to initiate the operation. This adds to cost and complexity of installation and operation.
8. The existing systems fail to start in automatic mode for extinguishing fire at offshore platforms. Common problems include:
   a. Fire water pumps needs start up air/gas volume bottle (vessel). Insufficient pressure in this vessel, causes starts up failure during Fire/Emergency.
   b. If start up vessel is to be filled with air, then air compressor is needed, which is difficult task at unmanned platform as; sufficient electric power is not available at unmanned platform.
   c. If start up vessel is to be filled with gas, which is abundantly available in the platform, then exhausted start up gas will be added into fire place which increases risk of fire hazard during that particular incident. Especially, there is not much use of manual start up for firefighting system at unmanned platform, as men are not residing there. Thus, safety of unmanned platforms is at risk; with existing firefighting systems.
9. Especially, the maintenance of fire water pump in prior art, is very tedious job; which requires lifting (pulling out) of 40 meter length column, (same length of shaft and numbers of impellers) from subsea level to deck level, is time consuming process and difficult. It needs sometimes more than one week; during the period platform runs in unsafe condition.
10. Diesel storage vessel is required for operation of fire water pump; wherein vessel itself has risks of catching fire. Tank Vessel also add on to the problems of space on said platform.
11. Moreover, diesel storage tank of the prior art systems, mounted on the body of engine, is also under fire risk.
12. Unmanned platform has limited space to install fire water lifting system that limit the selection of safe area for installation, hence, in spite of fire protection wall; there are chances of fire hazards on the running fire water pump during fire incident.
13. The existing systems being unreliable; lead to higher premium of insurance of the platform.
14. Marine growth at suction strainer, restrict flow rate of water, hence insufficient water flow during fire incident is big problem.
15. If battery required for startup of fire engine of fire water pump; failure of battery charging is day to day problem at unmanned platform. Battery charging at unmanned platform is done by solar panel installed at periphery of helideck. Sometimes high air blow of helicopter propeller damage this solar panel, and at other times, high wind storm also damage this solar panel. Above all every day dropping of sea birds excretion, block the solar sensitivity which stop power generation in solar panel and hence battery charging is questionable. And other option is power generation by Diesel Generator which is to be done only when, man will visit this unmanned platform.
16. The systems that uses water injection lines as a part of firefighting systems also suffer from throttling effect and problems associated with it; which includes:
   a. Due to high throttling effect, ice cooling take place around control valve and line chocking by ice formation may occur inside flow line which reduces flow rate of water.
   b. Due to high throttling, control valve sheet of control valve, erodes fast and causes valve passing problem. And passing of valve, during closed position of valve, is serious problem at offshore; because isolation valve must kept closed during normal period to avoid line build up pressure in downstream of flow. This situation (passing of control valve) creates two types of serious problems:
      i. Line between deluge valve & control valve may burst due to build up pressure in this line segment, because this segment is not designed for 100 kg/cm2 pressure.
      ii. If isolation valve kept closed to save this line segment, then, water flow cannot be generated during actual fire incident. Hence actual purpose of Fire-fighting could not be served.
   c. High throttling at control valve generate unbearable high noise pollution. Even if manpower is available at the platform, they cannot talk to each other.
   d. Due to high throttling of control valve, high vibration also take place in the line. It can damage flow line in a long run.

Objects of Invention

The main object of the present invention is to provide a submersible water lifting assembly and automatic fire fighting system for unmanned platforms having said system that is efficient yet simple to install, energy saving, noise free, and economical.

Another object of the present invention is to provide a submersible water lifting assembly and automatic fire-fighting system for unmanned platforms having said system wherein installation is possible by simple modification in existing offshore platform arrangement. This eliminates installation of additional multi-part arrangements thereby reduces the complexity in construction and operation.

Yet another object of the present invention is to provide a submersible water lifting assembly and automatic fire fighting system for unmanned platforms having said system that is self-cleaning and hence auto-maintenance.

Yet another objective of the present invention is to provide a submersible water lifting assembly and automatic fire fighting system for unmanned platforms having said system that eliminate risk of fire, on main body of water lifting system itself, by locating it into water body.

Yet another object of the present invention is to provide a submersible water lifting assembly and automatic fire fighting system for unmanned platforms having said system that requires minimum space for installation.

Yet another object of the present invention is to provide a submersible water lifting assembly and automatic fire-fighting system for unmanned platforms having said system that eliminates bulky and uneconomical installations; thereby making present invention simple and easy to install and economical.

Yet another object of the present invention is to provide a submersible water lifting assembly and automatic fire-fighting system for unmanned platforms having said system that ensures safeguard from fire; particularly to the unmanned platform and reduces the premium of insurance.

Yet another object of the present invention is to provide a submersible water lifting assembly and automatic fire-fighting system for unmanned platforms having said system that requires almost nil maintenance.

Yet another object of the present invention is to provide a submersible water lifting assembly and automatic fire fighting system for unmanned platforms having said system that is simple and safe to operate. It assures for valuable function of fire-fighting system.

Yet another object of the present invention is to provide a submersible water lifting assembly and automatic fire-fighting system for unmanned platforms having said system that utilizes internal energy available in the flow of water injection line and eliminates the requirement of external energy sources like Fuel; thereby saving said energy sources.

Yet another object of the present invention is to provide a submersible water lifting assembly and automatic fire fighting system for unmanned platforms having said system that also ensures to facilitate the utility requirements such as wash down pump.

BRIEF DESCRIPTION OF DRAWINGS

Figure 1A:
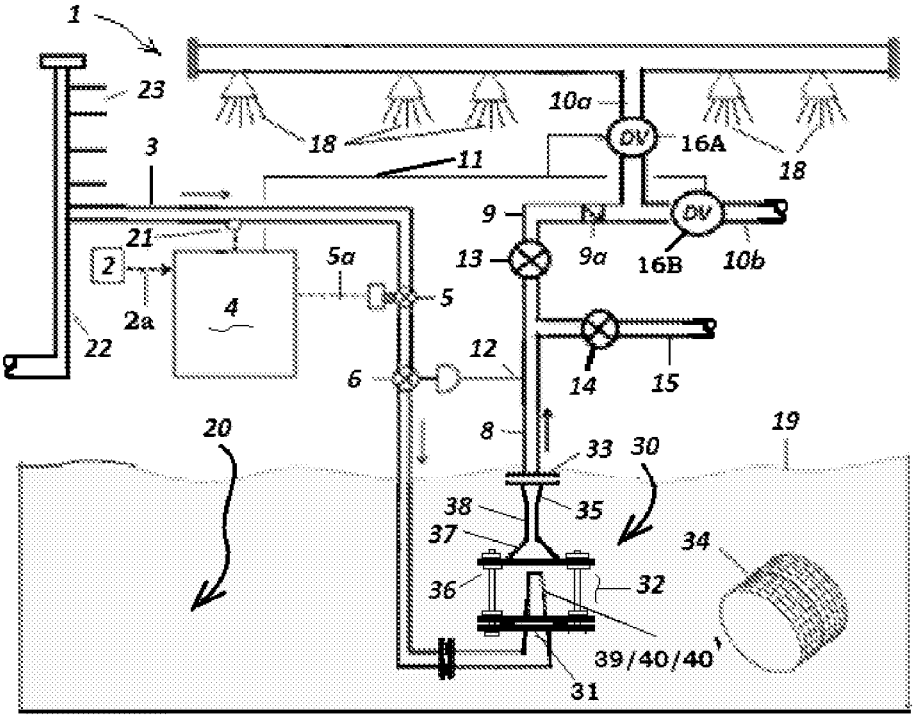
Figure 1B:
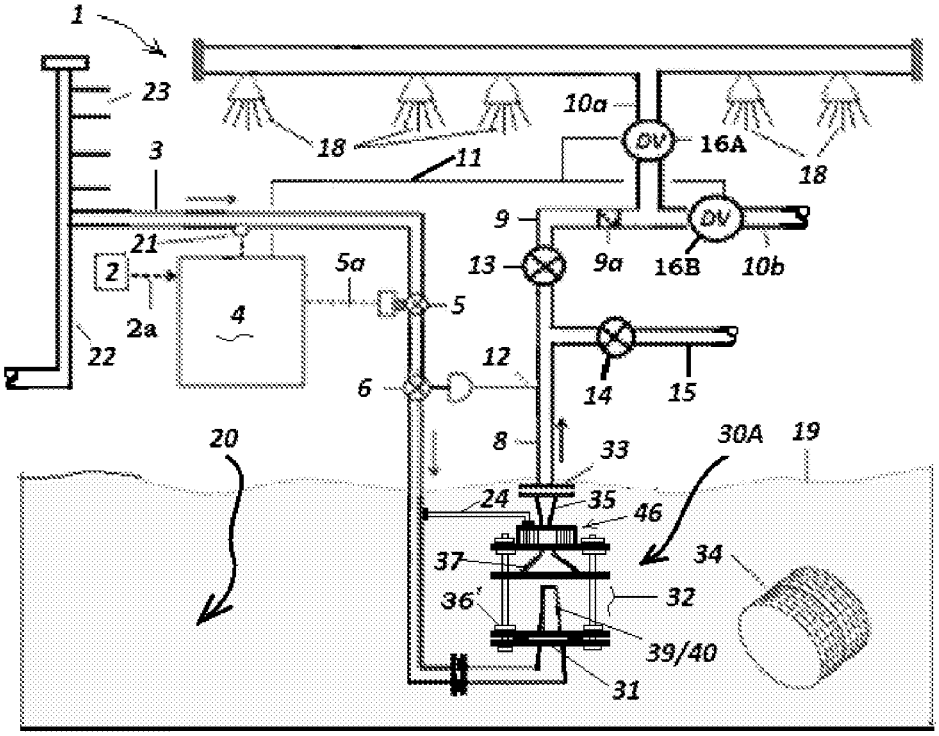

| | |
|---|---|
| FIG. 1A | Shows diagrammatic representation of present automatic firefighting system for unmanned platforms having submersible water lifting assembly |
| FIG. 1B | Shows diagrammatic representation of present automatic firefighting system for unmanned platforms having another embodiment of submersible water lifting assembly |

-continued

Figure 2A:
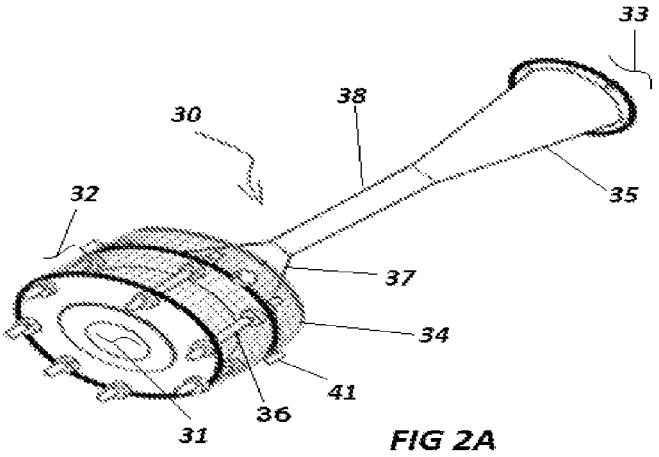
Figure 2B:
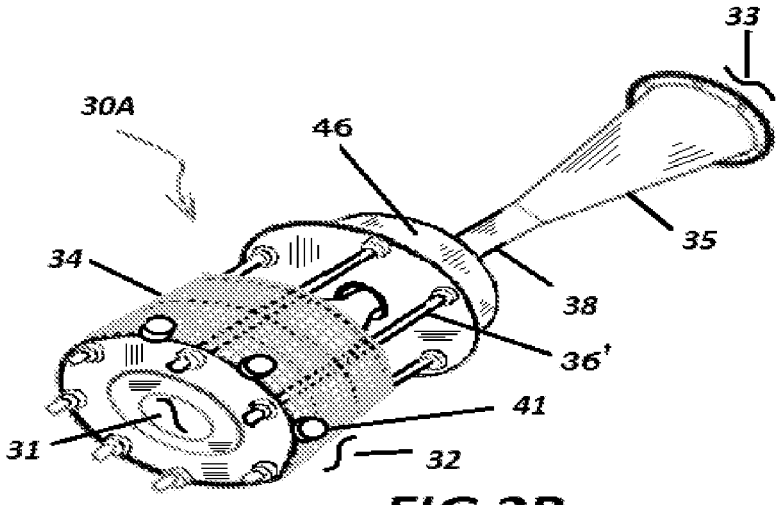
Figure 3A:
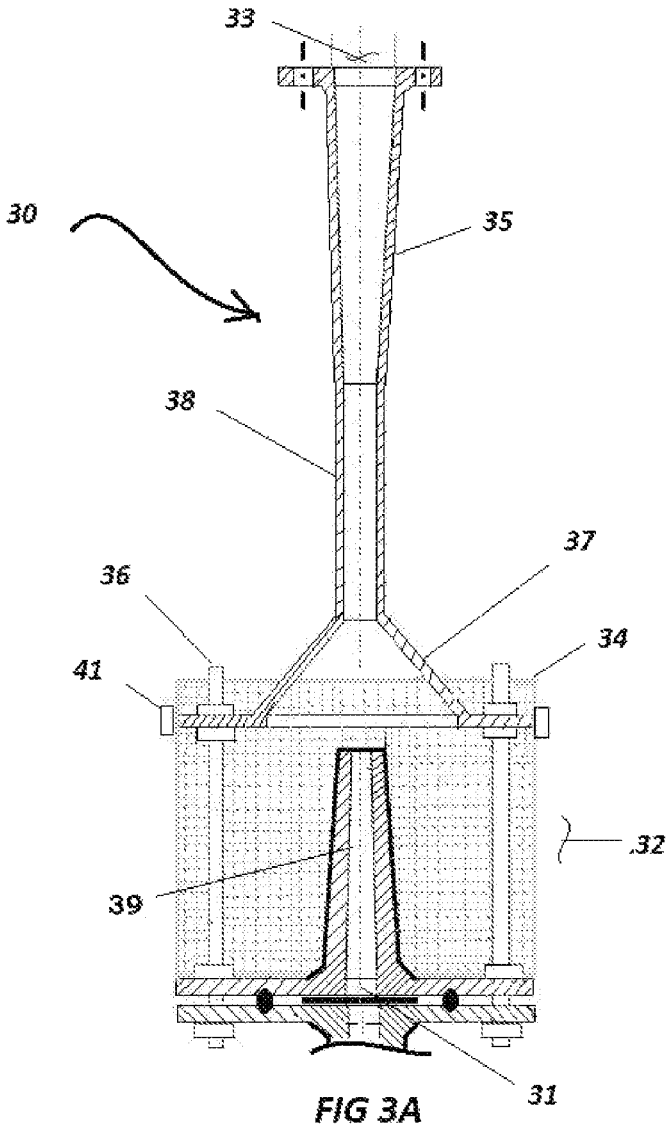
Figure 3B:
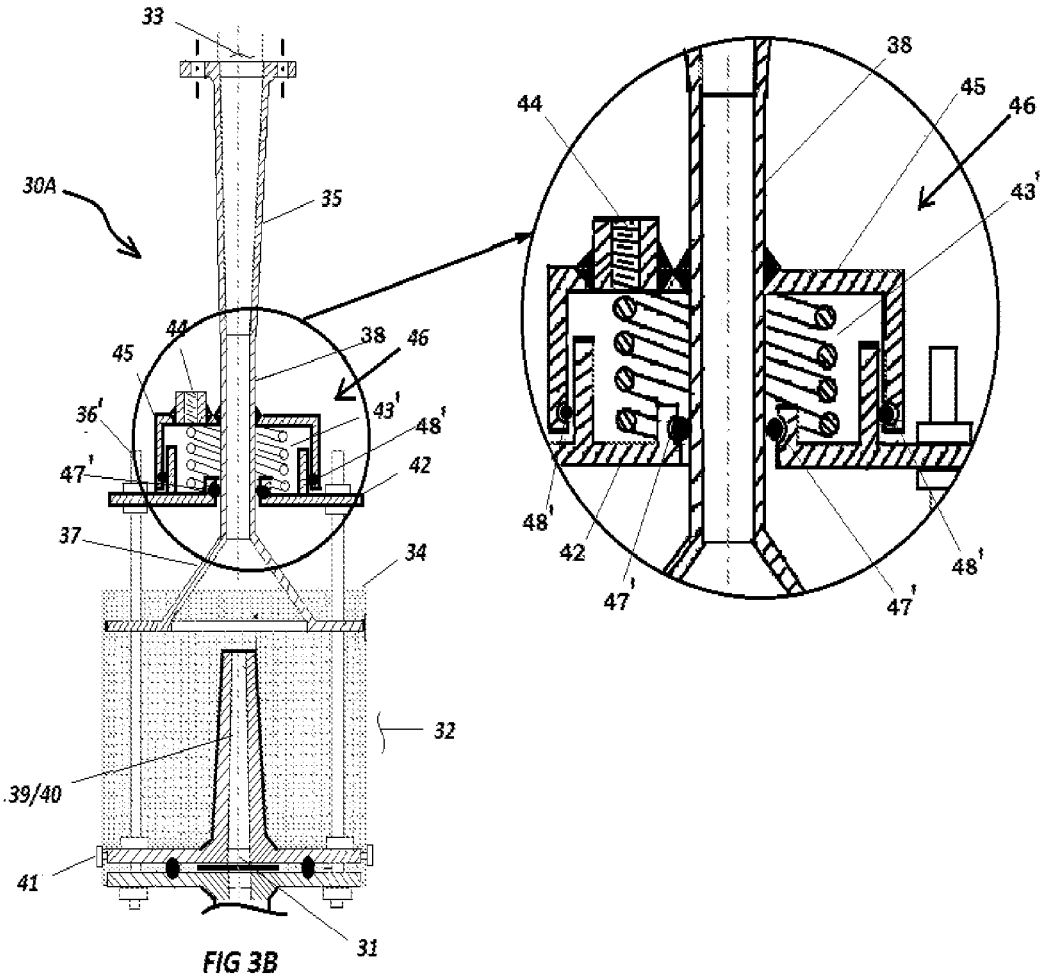
Figure 4:
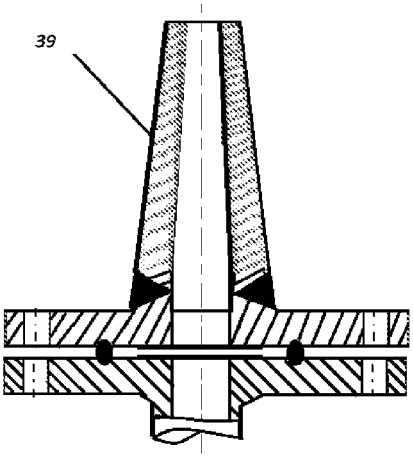
Figure 5:
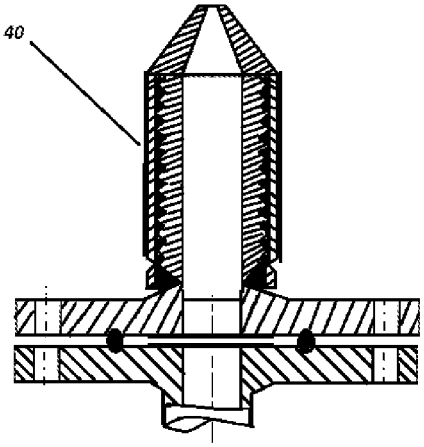
Figure 5A:
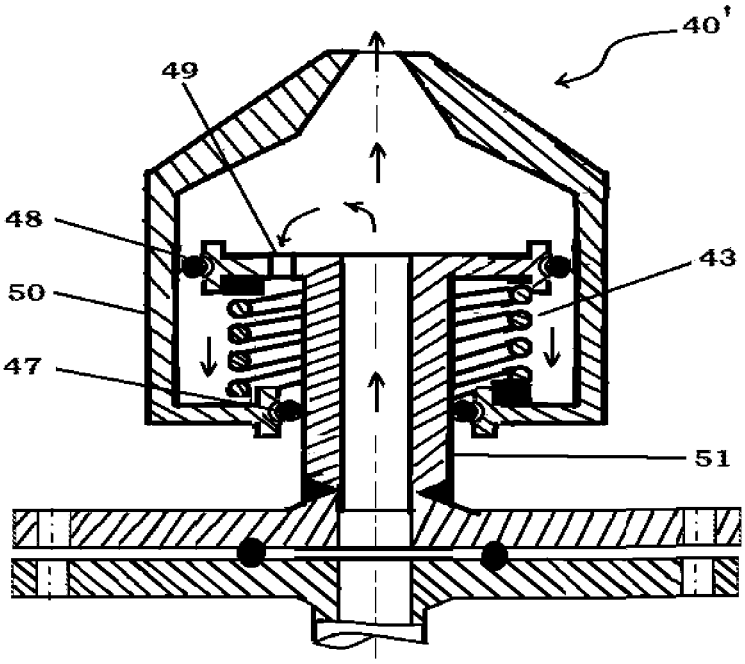
Figure 6:
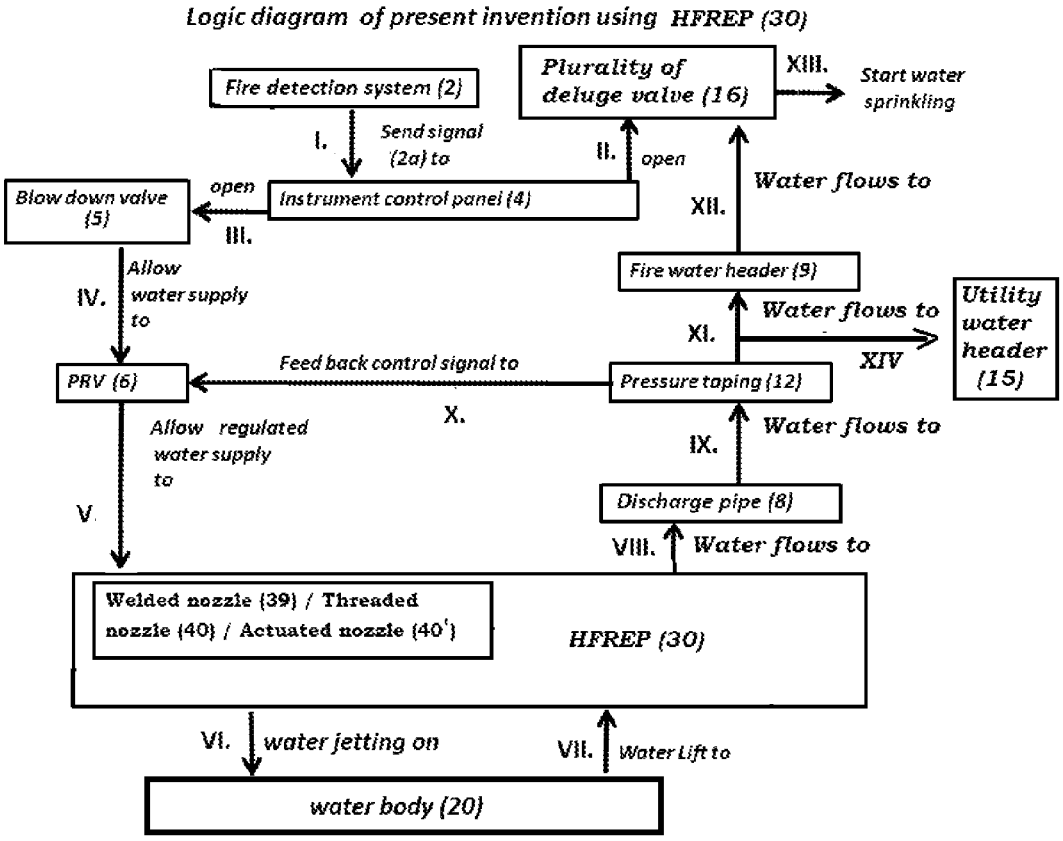
Figure 7:
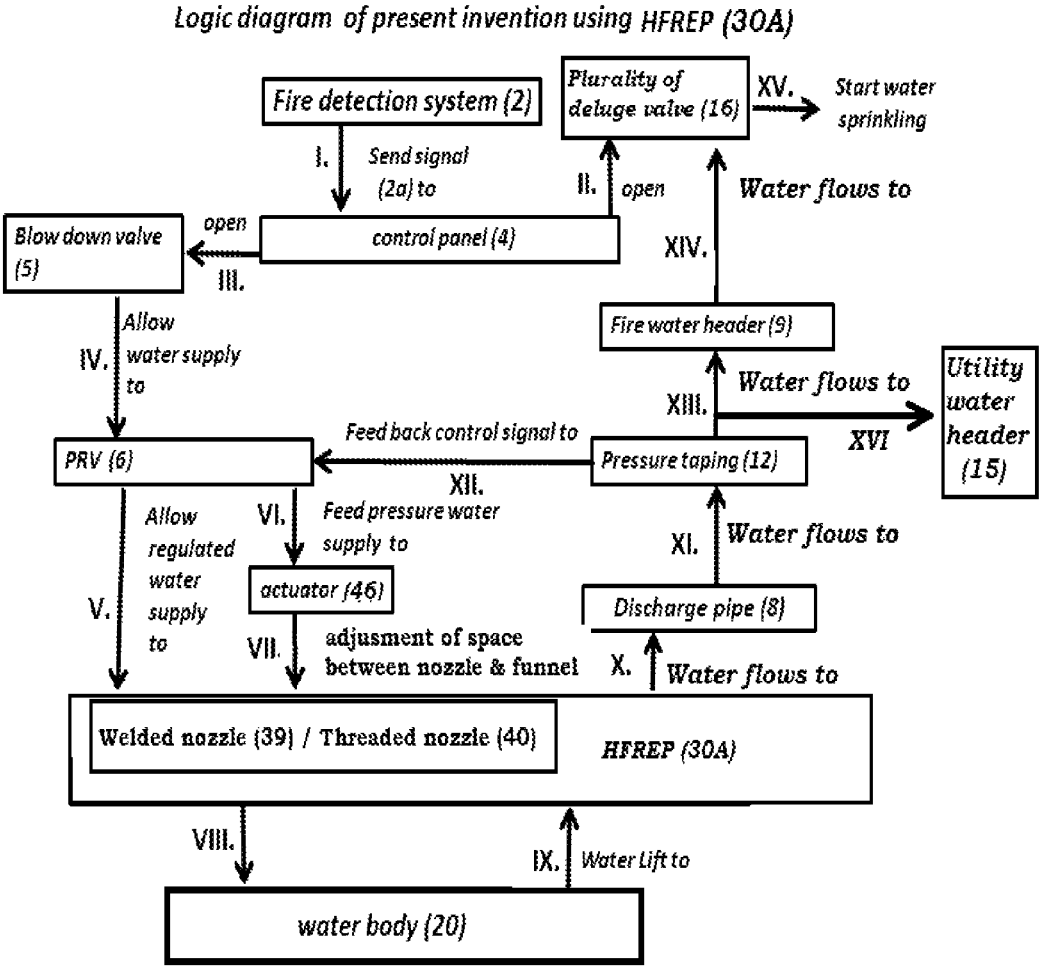
Figure 8:
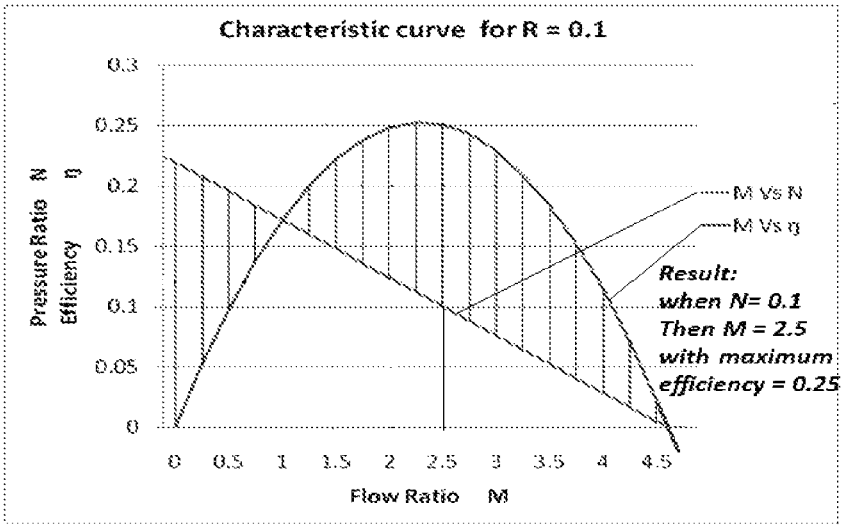
Figure 9:
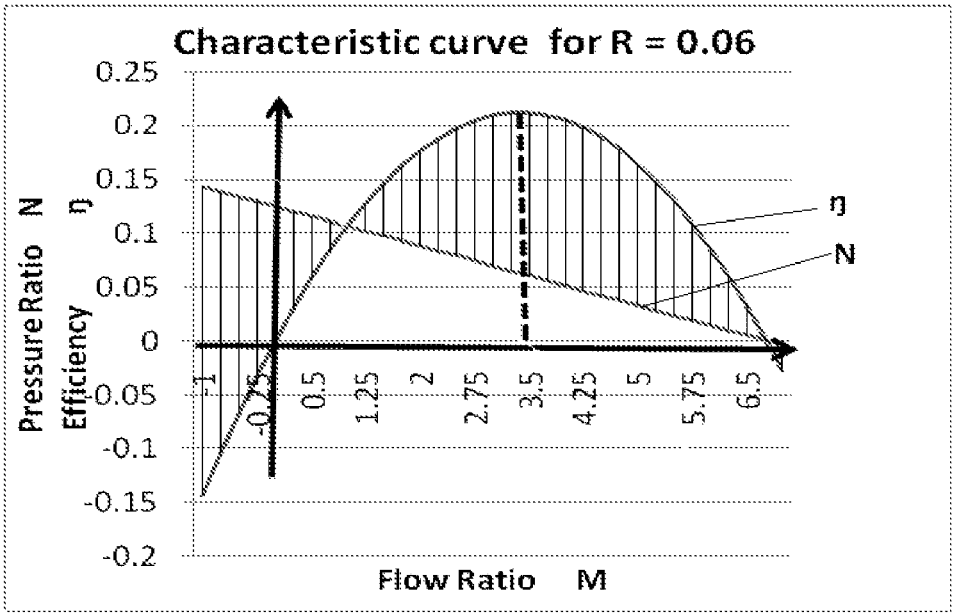

| | |
|---|---|
| FIG. 2A | Shows perspective view of present submersible water lifting assembly of present automatic firefighting system for unmanned platforms having said assembly |
| FIG. 2B | Shows perspective view of another embodiment of the present submersible water lifting assembly of present automatic firefighting system for unmanned platforms having said assembly |
| FIG. 3A | Shows longitudinal cross sectional view of present submersible water lifting assembly of present automatic firefighting system for unmanned platforms having said assembly |
| FIG. 3B | Shows longitudinal cross sectional view of another embodiment of present submersible water lifting assembly of present automatic firefighting system for unmanned platforms having said assembly |
| FIG. 4 | Shows enlarged Cross sectional view of welded nozzle (39); a component of HFREP (30 or 30A), shown in FIG. 3A & FIG. 3B; an alternative of threaded nozzle (40) |
| FIG. 5 | Shows enlarge Cross sectional view of threaded nozzle (40); a component of HFREP (30 or 30A), shown in FIG. 3A & FIG 3B; an alternative of welded nozzle (39) |
| FIG. 5A | Shows enlarge Cross sectional view of actuated nozzle (40'); a component of HFREP (30), shown in FIG. 3A; an alternative of welded nozzle (39) & threaded nozzle (40). |
| FIG. 6 | Shows illustrative flowchart for working of the present firefighting system with respect to embodiment HFREP (30) |
| FIG. 7 | Shows illustrative flowchart for working of the present firefighting system with respect to embodiment HFREP (30A) |
| FIG. 8 | Shows graph of flow ratio M verses pressure ratio N and flow ratio M verses efficiency $\eta$; for area ratio R is 0.1 for illustration of Example 1 |
| FIG. 9 | Shows graph of flow ratio M verses pressure ratio N and flow ratio M verses efficiency $\eta$; for area ratio R is 0.06 for illustration of Example 2 |

MEANING OF REFERENCE NUMERALS OF SAID COMPONENT PARTS OF PRESENT INVENTION

| | |
|---|---|
| 1 | Present automatic firefighting system for unmanned platforms having submersible water lifting assembly. (Referred herein after as present invented system) |
| 2 | Fire detection system |
| 2a | First line for Fire signal transmission |
| 3 | Water Inlet line |
| 4 | Control Panel |
| 5 | Blow down Valve |
| 5a | Instrument control line |
| 6 | Pressure Regulating Valve |
| 8 | Discharge water line |
| 9 | Fire water header |
| 9a | Non Return Valve |
| 10 | Plurality of water sprinkler header |
| 10a | First water sprinkler header |
| 10b | Second water sprinkler header |
| 11 | Second line for Fire signal transmission |
| 12 | Pressure taping |
| 13 | Fire water header isolation valve |
| 14 | Utility water header isolation valve |
| 15 | Utility water header |
| 16 | Plurality of deluge valve |
| 16A | First Deluge valve |
| 16B | Second Deluge valve |
| 18 | Sprinklers |
| 19 | Sea level surface |
| 20 | Water body |
| 21 | Supply pressure line |
| 22 | Water injection header |
| 23 | Plurality of water injection well |
| 24 | Pre-feed pressure tube |
| 30 | High Flow Ratio Ejector Pump (referred herein after as HFREP) |
| 30A | Another embodiment High Flow Ratio Ejector Pump |
| 31 | Primary water inlet |
| 32 | Secondary water inlet |

-continued

| | |
|---|---|
| 33 | Discharge outlet |
| 34 | Suction Strainer |
| 35 | Diffuser, Work as pressure recovery unit |
| 36 | Plurality of first studs |
| 36' | Plurality of second studs |
| 37 | Funnel |
| 38 | Mixing chamber |
| 39 | Welded Nozzle |
| 40 | Threaded Nozzle (alternative of welded nozzle (39)) |
| 40' | Actuated Nozzle |
| 41 | Bolts & nuts |
| 42 | Cylinder mounted circular plate |
| 43 | First tension spring |
| 43' | Second Tension spring |
| 44 | Drum inlet connection |
| 45 | Hydraulic Drum |
| 46 | Actuator |
| 47 | First movable slip ring |
| 47' | Second movable slip ring |
| 48 | First stationary slip ring |
| 48' | Second stationary slip ring |
| 49 | Communicating hole |
| 50 | Nozzle mounted hydraulic drum |
| 51 | Cylindrical pedestal |

SUMMARY OF THE INVENTION

Water injection systems described herein above is used by the applicant for the purpose of the present invention; in such a manner that overcomes the risks associated with high pressure. The applicant of the present invention has utilized the available high pressure water flow, in system, for its use in emergency situation of major fire. The system is developed such that the emergency as well as the purpose of fire extinguishing is served using the available water supply arrangement.

Said water injection system has main water supply line known as water injection header (22) from which, water can be distributed to different wells through sub-lines; a water inlet line (3) is directed from said water injection header (22) at a platform to the present invented system (1) to act as a water inlet for the present invented system (1).

The applicant has developed the present invention to utilize the pressurized water for present invented system (1) such that the system controls the pressure; making it utilizable for the purpose as well as it provides a mechanism of utilizing water from the water body (20) (sea) along with it; so as to get maximum benefit of the available water while eliminating wastage of pressurized water placed there for oil extraction.

DETAILED DESCRIPTION OF INVENTION

The present invention relates to a submersible water lifting assembly and automatic fire fighting system for unmanned platforms having said present invented system (1) that is efficient yet simple to install, energy saving, noise free and economical.

More particularly, the present submersible water lifting assembly and automatic fire fighting system for unmanned platforms having said system for automatic fire-fighting (shown diagrammatically in FIG. 1A, 1B), utilizes under water arrangements of unmanned platform for fire-fighting. Thus, the system is fire risk free, feasibly installed within available arrangements and is thus cost effective and easy to construct; yet is efficient. This eliminates requirement of space on platforms and ensuring fire safety of the system itself unlike the prior art.

Present submersible water lifting assembly; for the purpose of present invention; is a High Flow Ratio Ejector Pump (30 or 30A) (referred herein after as HFREP) that utilizes under water arrangements of unmanned platform and enables the fire-fighting system to efficiently lift water from the sea water; using the force of existing water injection system; eliminating the requirement of diesel engine driven pump, for the lifting of water. Thus, said High Flow Ratio Ejector Pump (30 or 30A) enables fire safety without use of bulky engine driven fire water pump; unlike that of the prior art.

Referring to FIGS. 1A, 2A, 3A, 4, 5, and 5A; shows the said High Flow Ratio Ejector Pump (30) [hereinafter referred to as HFREP (30)] of the first embodiment of the present invention. Said HFREP (30) mainly comprises of:

Primary water inlet (31),
Secondary water inlet (32),
Discharge outlet (33),
Suction Strainer (34),
Diffuser (35),
Plurality of first studs (36),
Funnel (37),
Mixing chamber (38),
Welded Nozzle (39),
Threaded Nozzle (40),
Actuated nozzle (40'),
Plurality of bolts & nuts (41),
First tension spring (43),
First Movable slip ring (47),
First stationary slip ring (48),
Communicating hole (49),
Nozzle mounted hydraulic drum (50),
Cylindrical pedestal (51).

Wherein said HFREP (30) is provided to receive high pressure primary flow of water from the water inlet line (3), through its primary water inlet (31) to utilize the energy of the flow of water and create the suction within the HFREP (30) generating secondary flow; to suck additional water from the water body (20) through its secondary water inlet (32). Welded nozzle (39) attached to primary inlet (31) facilitates primary water to enter the HFREP (30) from said primary inlet (31). Alternatively, a threaded nozzle (40) is used where height of the threaded nozzle (40) is adjustable with use of threads provided therein or actuated nozzle (40') is used for automatic height adjustment as per fluctuation in supply pressure (pressure of primary water flow). The high flow of water induces low pressure zone in the area surrounding the tip of said welded nozzle (39) or threaded nozzle (40) or actuated nozzle (40'). This in turn results in flow of water from water body (20) to the HFREP (30). Said flow is the secondary flow of water into the HFREP (30) and the area surrounding the nozzle (39 or 40 or 40') from where the secondary flow enters, forms the secondary inlet (32).

A suction strainer (34) is provided to allow only strained water to enter from the secondary inlet (32) thereby preventing entry of marine substances and in turn chocking of the HFREP (30). A funnel (37) is placed at a pre-fixed distance above the nozzle (39 or 40 or 40') by attaching the flange of the funnel (37) with the flange of the nozzle (39 or 40 or 40') using plurality of first studs (36) by plurality of bolts & nuts (41). Said funnel (37) is provided to collect the secondary flow from water body (20) as well as primary flow from primary water inlet line (31) and direct it towards the mixing chamber (38). Said plurality of first studs (36) maintains said pre-fixed distance and provides support to said strainer (34) and attached as well as fixed with flange of funnel (37), by plurality of bolts & nuts (41). Said pre-fixed distance is manually adjustable to achieve maximum flow ratio (secondary flow to primary flow) according to available supply pressure (In general practice of designing ejector, the space between nozzle and mixing chamber is generally kept same as that of the diameter of mixing chamber. This is called prefixed distance.) wherein; if the provided pressure of primary flow (supply flow) is high, then the distance between the tip of nozzle (39 or 40 or 40') and funnel (37) should be more which can be adjusted by manual replacement of other welded nozzle (39) or by rotating the threaded nozzle (40) or by automatic adjustment of actuated nozzle (40') and if the provided primary pressure is low then the distance between the tip of nozzle (39 or 40 or 40') and funnel (37) should be less which can be adjusted by manual replacement of other welded nozzle (39) or by rotating the threaded nozzle (40) or by automatic adjustment of actuated nozzle (40'). A mixing chamber (38) follows the funnel (37); wherein primary and secondary flow of water enters and where energy transformation takes place between said two flows, for maximum recovery of pressure energy, from the primary flow. A diffuser (35) following said mixing chamber (38) receives the water flow, which is a mixture of two flows (primary flow and secondary flow) from mixing chamber (38) to achieve maximum pressure in it. A discharge outlet (33) receives the water from said diffuser (35) and passes to discharge water line (8).

Specifically, an actuated nozzle (40') is provided to adjust the tip of nozzle as per pressure fluctuation in primary flow. Said actuated nozzle (40') comprises first tension spring (43), communicating hole (49), nozzle mounted hydraulic drum (50), cylindrical pedestal (51), first movable slip ring (47) and first stationary slip ring (48). Wherein, said hydraulic drum (50) received pressure of primary flow of water from primary water inlet (31) and cylindrical pedestal (51). Said cylindrical pedestal (51) provides passage for primary flow and facilitate sealing & slipping arrangement for slip rings, to guide or limit movement arrangement of nozzle mounted hydraulic drum (50) and to support first tension spring (43). Said first tension spring (43) is supported by nozzle mounted hydraulic drum (50) and cylindrical pedestal (51). Said communicating hole (49) provides the entry of water into the enclosed space between said hydraulic drum (50) and cylindrical pedestal (51) and exert more pressure inside this enclosed space, thus volume of this enclosure expands. Said first movable slip ring (47) and first stationary slip ring (48) provides movement of the nozzle mounted hydraulic drum downwards through sliding down as shown in FIG. 5A. Thus said actuated nozzle (40') also moves downward wherein it increases space between mixing chamber (38) & tip of the nozzle (40'). Said first tension spring (43) is provided to reduce the space between tip of actuated nozzle (40') and mixing chamber (38) when it receives decreased pressure of primary flow.

The submersible water lifting assembly [HFREP (30)] of present automatic fire-fighting system, is placed below water surface level (19) (see FIG. 1A and FIG. 1B); facilitating utilization of water from water body (20) (sea) for fire-fighting as well as safe guarding said assembly itself from fire risk.

Referring to FIGS. 1B, 2B, 3B, 4 and 5; shows the said High Flow Ratio Ejector Pump (30A); an alternative embodiment HFREP (30A) of the present invention. Said HFREP (30A) mainly comprises of:

Primary water inlet (31),
Secondary water inlet (32),
Discharge outlet (33),
Suction Strainer (34),
Diffuser (35),
Plurality of second studs (36'),
Funnel (37),
Mixing chamber (38),
Welded Nozzle (39),
Threaded Nozzle (40),
Plurality of bolts & nuts (41),
Cylinder mounted circular plate (42),
Second Tension spring (43'),
Drum Inlet connection (44),
Hydraulic drum (45),
Actuator (46),
Second movable slip ring (47')
Second stationary slip ring (48').

Wherein said HFREP (30A) is provided to receive high pressure primary flow of water from the water inlet line (3), through its primary water inlet (31) to utilize the energy of the flow of water and create the suction within the HFREP (30A) generating secondary flow; to suck additional water from the water body (20) through its secondary water inlet (32). Welded nozzle (39) is attached to primary inlet (31) facilitates primary water to enter the HFREP (30A) from said primary inlet (31). Alternatively, a threaded nozzle (40) is used where adjusting height of the nozzle (40) is required. The high flow of water induces low pressure zone in the area surrounding the tip of said welded nozzle (39) or threaded nozzle (40). This in turn results in flow of water from water body (20) to the HFREP (30A). Said flow is the secondary flow of water into the HFREP (30A) and the area surrounding the nozzle (39 or 40) from where the flow enters, forms the secondary inlet (32).

A suction strainer (34) is provided to allow only strained water to enter from the secondary inlet (32) thereby preventing entry of marine substances and in turn chocking of the HFREP (30A). A funnel (37) is placed at a pre-fixed distance as per provided primary flow, above the nozzle (39 or 40) by attaching the flange of the funnel (37) with the flange of the nozzle (39 or 40) using plurality of second studs (36') by plurality of bolts & nuts (41). Said pre-fixed distance is manually adjustable to achieve desired distance between the tip of nozzle (39 or 40) and funnel (37) for maximum discharge flow as per provided primary flow; wherein if the provided primary flow is high then the distance between the tip of nozzle (39 or 40) and funnel (37) should be more, which can be adjusted manually by replacing welded nozzle (39) or by rotating the threaded nozzle (40); further if the provided primary flow is low then the distance between the tip of nozzle (39 or 40) and funnel (37) should be less which can be adjusted manually by replacing welded nozzle (39) or by rotating the threaded nozzle (40). Said funnel (37) is provided to collect the secondary flow from water body (20) as well as primary flow from primary inlet line (31) and direct it towards the mixing chamber (38). Said plurality of second studs (36') maintains said fixed distance and provides support to said strainer (34) and top ends of the studs (36') are fixed with cylinder mounted circular plate (42); wherein the bottom ends of the studs (36') are fixed with nozzle (39 or 40). Whereas, the flange of funnel (37) is not fixed with the plurality of second stud (36') but allows to slip through holes in the flange. Hence said funnel (37) is free to move. The holes, in the flange of funnel (37), guides the plurality of studs (36') for linear motion. A mixing chamber (38) follows the funnel (37); wherein primary and secondary flow of water enters and where energy transformation takes place between said two flows, for maximum recovery of pressure energy, from the primary flow. A diffuser (35) following said mixing chamber (38)

receives the water flow, which is a mixture of two flows (primary flow and secondary flow) from mixing chamber (38) to achieve maximum pressure in it. A discharge outlet (33) receive the water from said diffuser (35) and passes to discharge water line (8). Said plurality of bolts & nuts (41) are provided for fixing of suction strainer (34) with flange of nozzle [welded nozzle (39) or threaded nozzle (40)]. The special mechanism is provided by actuator (46) to adjust space between nozzle [welded nozzle (39) or threaded nozzle (40)] and mixing chamber (38).

An actuator (46) is provided for resolving the pressure fluctuations in primary flow while adjusting the distance between the tip of nozzle (39 or 40) and funnel (37) as per pressure fluctuations in primary flow; in order to achieve maximum discharge flow. Said actuator (46) is connected to flange of nozzle (39 or 40) through plurality of second studs (36') such that cylinder mounted circular plate (42) of the actuator is attached to the mixing chamber (38) by second movable slip ring (47') and Second stationary slip ring (48') as shown in FIG. 3B. Said actuator (46) is further attached to the water inlet line (3) through a pre-feed pressure tube (24) to receive pressurised water from water inlet line (3).

Said actuator (46) comprises of cylinder mounted circular plate (42), Second tension spring (43'), hydraulic drum (45), drum inlet connection (44), second stationary slip ring (48') and second moveable slip ring (47'). Wherein said actuator (46) receives pressurised water from water inlet line (3) in its hydraulic drum (45) from pre-feed pressure tube (24) through drum inlet connection (44). Said drum inlet connection (44) facilitates the pressure tubing connection between water inlet line (3) and hydraulic drum (45); the received pressure of primary flow of water from water inlet line (3) exerts pressure on cylinder mounted circular plate (42). Said hydraulic drum (45) provides mounting of Second tension spring (43') and facilitates holding of the hydraulic pressure received from primary flow through drum inlet connection (44). Said second moveable slip ring (47') provides slipping between mixing chamber (38) and cylinder mounted circular plate (42); and second stationary slip ring (48') provides slipping between hydraulic drum (45) and cylinder mounted circular plate (42). Said second tension spring (43') is provided to restore the position of funnel (37) and nozzle (39 or 40) tip when supply pressure (primary pressure) is at set pressure value, to achieve maximum ratio of flow and eliminate possibility of cavity formation; resulting by creation of low pressure that is less than vapour pressure of water in mixing chamber (38) due to very high velocity of primary flow, which can be avoided by reduction of pressure of primary flow or increase of secondary pressure, or reduction in flow ratio or increasing area ratio [ratio of cross sectional area of nozzle tip (39) to cross sectional area of mixing chamber (38)] and change in pressure ratio [ratio of secondary flow pressure rise to primary flow pressure drop]; which is not desirable for fire-fighting system. (As firefighting must not be stop to make these changes in between firefighting operation)

When the increased pressure is received by said hydraulic drum (45), it pushes the cylinder mounted circular plate (42) and thereby the attached funnel (37) moves downward by slipping over each other through second stationary slip ring (48') and second moveable slip ring (47'), which increases the space between nozzle [39 or 40] and funnel (37) as per increased pressure of primary flow. And if the pressure of primary flow is decreased, the second tension spring (43') takes action to reduce the space between nozzle (39 or 40) and funnel (37).

The submersible water lifting assembly HFREP (30) or (30A) of present automatic fire-fighting system, is placed below water surface level (19) (see FIG. 1A and FIG. 1B); facilitating utilization of water from water body (20) (sea) for fire-fighting as well as safe guarding said assembly itself from fire risk.

Referring to FIGS. 1A & 1B; which shows preferred embodiments of the present invented invention (1); wherein water injection system of a platform of oil and gas industry is utilized to provide present automatic firefighting system for offshore platforms that is easy to install and operate, yet is efficient and economical. Said present invented system (1) mainly comprises of:

Fire detection system (2),
First line for Fire signal transmission (2*a*),
Water inlet line (3),
Control Panel (4),
Blow down Valve (5),
Instrument control line (5*a*),
Pressure Regulating Valve (6),
High Flow Ratio Ejector Pump (30 or 30A) (referred herein after as HFREP),
discharge water line (8),
fire water header (9),
Non Return Valve (9*a*),
Plurality of water sprinkler header (10),
First water sprinkler header (10*a*),
Second water sprinkler header (10*b*),
Second line for Fire signal transmission (11),
Pressure tapping (12),
Fire water header isolation valve (13),
Utility water header isolation valve (14),
Utility water header (15),
Plurality of deluge valve (16),
First Deluge valve (16A),
Second Deluge valve (16B),
Plurality of Sprinklers (18),
Water surface level (19),
Water body (20) [sea],
Supply pressure line (21),
Water injection header (22),
Plurality of Water Injection Wells (23),
Pre-feed Pressure tube (24).

Fire detection system (2); is part of oil & gas operation, at platforms it is utilized for obtaining fire signal, through first line for fire signal transmission (2*a*) to activate the present invented system (1) for firefighting.

Said fire signal is further transmitted to plurality of deluge valve (16) through second line for fire signal transmission (11) from control panel (4); to open First deluge valve (16A) or second deluge valve (16B) or both or more. The control panel (4) is preferably powered by water pressure taken from water inlet line (3) through supply pressure line (21); or otherwise it can also be powered by pneumatic/electric power as per location where system is used. Similarly, pre-feed pressure tube (24) is also tapped from water inlet line (3) for controlled operation of HFREP (30A).

The water inlet line (3) is connected with water injection header (22); wherein said water inlet line (3) tapped from water injection header (22) to provide pressurized water to the present invented system (1). The plurality of water injection wells (23) is also connected with said water injection header (22); for operation of present invented system (1) where water injection header (22) is part of platform. The inflow of water from the water inlet line (3) is controlled by pressure regulating valve (6); wherein said pressure regulating valve (6) regulates pressure of the water flow. The inflow of water from the water inlet line (3) is controlled by pressure regulating valve (6) provided in water inlet line (3), with the help of feedback pressure from pressure tapping (12), provided in discharge water line (8); Said water has a high pressure and cannot be used directly for the purpose of extinguishing the fire. Thus, a mechanism of pressure control is provided in the present invented system (1) to best utilize the available source of water for fire extinguishing. Said control panel receives fire signal through first line for fire signal transmission (2*a*); form fire detection system (2) which activates blow down valve (5) through instrument control line (5*a*), and permits pressurised water to enter the present invented system (1) through water inlet line (3) and primary water inlet (31). At the same time, said control panel (4) direct the fire signal to open plurality of deluge valve (16) [First deluge valve (16A) or second deluge valve (16B) or both or more] through second line for fire signal transmission (11).

The submersible water lifting system (30 or 30A) receive high pressure water from the water inlet line (3) through its primary water inlet (31) to utilize the energy of the same and create the suction within the HFREP (30 or 30A) to suck more water from the water body (20) (sea) through its secondary water inlet (32), within which the present invented system (1) is used, and thereby reduce the pressure of the primary water flow and increase the amount of the water to be flowing within the system; without use of any external source of energy. The primary water flow with reduced pressure and increased amount of water flow discharges from the HFREP (30 or 30A) to the discharge water line (8) through discharge outlet (33).

A suction strainer (34) is provided on the secondary water inlet (32) to avoid the entry of marine substances. It is pertinent to note that the water suction from the water body (20) is as high as enabling suction of multiple times of water flow as compared to the originally received pressurised water flow; resulting into utilization of maximum water from the abundant and free water source and eliminating wastage of energy stored in the pressurized water. It also minimise the use of high pressure water which is required for other important purposes.

Said discharge water line (8) receive water flow form the HFREP (30 or 30A) through discharge outlet (33) and passes water flow to fire water header (9) as well as non-return valve (9*a*); wherein non-Return Valve (9*a*) are provided to facilitate single side flow of water for fire-fighting. Said plurality of water sprinkler header (10) receive said water and is provided to spray water on fire area; amongst which, a first water sprinkler header (10*a*) is provided to sprinkle water in upper deck area and a second water sprinkler header (10*b*) is provided to sprinkle water in lower deck area, and also provided to spray water, over fire caught area through plurality of Sprinklers (18). The plurality of deluge valve (16) is provided to allow passing of water to said first water sprinkler header (10*a*) or second water sprinkler header (10*b*) or both or more headers; depending upon the area in which fire has taken place. This directs the water to the fire affected area only; and avoids wastage of water by blocking passage of water in other areas. Further, depending on the plurality of water sprinkler header (10) arranged in different regions of the platform; plurality of deluge valve (16) is provided to facilitate in directing the water flow in area where fire is existing.

The submersible water lifting assembly of present automatic fire-fighting system is placed below water surface level (19), facilitating utilization of water from water body (20) (sea) for fire-fighting as well as safe guarding said assembly itself from fire risk.

Said present invented system (1) also has provisions to allow the water to be used for other purposes including cleaning. The Fire water header isolation valve (13) is thus provided; which can be closed and utility water header isolation valve (14) can be opened so as to allow said resultant water to pass through Utility water header (15) for said purposes. Also, said fire water header isolation valve (13) and utility water header isolation valve (14); both can be closed to ensure water discharge from secondary water inlet (32) into the water body (20) (sea), for cleaning of the suction strainer (34). This ensures there is no blockage by marine substances and allows ready infusion of water through secondary water inlet (32). This makes the maintenance simple and efficient. Also, there is no requirement of rendering the platform at risk of fire, during maintenance of fire-fighting system unlike the prior arts.

Wherein, modifications in the present invented system (1) for accommodating present water lifting assembly i.e. HFREP (30 and 30A) involves the modifications in terms elimination of complex arrangements of air or gas start up vessel, diesel storage vessel, diesel tank, diesel engine, gear box, multi stage centrifugal pump, vertical column casing, 40 meter length heavy duty shaft and related arrangements of its supply and usage during operation of said prior art system. The elimination of said parts results in simplified rearrangement of remaining parts to provide a simple yet efficient said system (1) as shown in FIG. 1A & FIG. 1B and as described herein. The obtained present invented system (1) utilizes novel water lifting system (30 and 30A) as described herein above; which works without requirement of external energy sources and avoids wastage of water; yet is efficient in supplying water to the present invented system (1) for extinguishing fire; even at an unmanned platform.

Further, herein before disclosed are the preferred embodiments of the present invented systems (1) with reference to accompanying drawings. Here, it is to be noted that the present invention is not limited thereto and can be used for varied applications including firefighting systems for onshore and water transport systems for transporting water from lower level to higher levels. The components like flow meters drain lines tappings with drain valves, pressure gauges, blinds, plugs, isolation valve etc. are not shown in the FIG. & not described as it is understood & still in the scope of the intervention. Furthermore, the component parts described are not meant there to limit its operating, and any rearrangement of the component parts for achieving the same functionality is still within the spirit and scope of the present invention. It is to be understood that the drawings are not drawn to scale and are only for illustration purposes.

Working of the Invention

Referring to FIGS. 1A, 2A, 3A 4, 5, 5A and 6: with respect to embodiment HFREP (30)

I. When fire take place in area of platform, the fire detection system (2) transmit the fire signal, through First line for Fire signal transmission (2*a*); which is received by control panel (4).

II. Said fire signal is further transmitted to second line for Fire signal transmission (11) of area where fire took place and open plurality of deluge valve (16).

III. The Control Panel (4) simultaneously send signal to open blow down valve (5) through instrument control line (5*a*) which provided in water inlet line (3).

IV. Said blow down valve (5) is opened and allow water flow from water injection header (22), attached with plurality of water injection well (23); through the water inlet line (3); enters into pressure regulating valve (6).

V. The said pressure regulating valve (6), regulate the pressure of water flow and allows water flow to enter into nozzle (39 or 40 or 40') of HFREP (30), which is placed below water surface level (19), into water body (20) and enters through primary water inlet (31).

VI. Said primary water inlet (31) allow water flow to enter into the nozzle (39 or 40 or 40'); wherein a. said nozzle (39 or 40 or 40') converts water flow into high velocity water jet, which strikes on area of water body (20); enclosed between conical area of funnel (37) and tip of nozzle [welded nozzle (39) or threaded nozzle (40)].

b. Specifically, actuated nozzle (40') is useful when the primary pressure increase in the space below tip of actuated nozzle (40'); wherein, when the water enters into enclosed space between hydraulic drum (50) and cylindrical pedestal (51), through communicating hole (49) and exert more pressure inside this enclosed space so, volume of enclosure expands. As a result, the actuated nozzle (40') mounted on hydraulic drum (50) move downward by sliding over first movable slip ring (47) and first stationary slip ring (48). Hence increases space between mixing chamber (38) & tip of the actuated nozzle (40') as shown in FIGS. 5A and 6A. And if pressure of primary flow decreases the first tension spring (43) take action to reduce the space between tip of actuated nozzle (40') and mixing chamber (38).

VII. The impact of water jetting pushes the effected water (primary water and secondary water) inside said funnel (37) and directed towards mixing chamber (38). When water from water body (20) move toward mixing chamber (38) through said funnel (37) the low pressure generated in this area; creates water flow from water body (20) to mixing chamber (38), through secondary water inlet (32) and suction strainer (34); and starts water lifting from water body.

VIII. The lifted water in mixing chamber (38) along with primary water travels toward diffuser (35) and proceed to discharge outlet (33). Form said discharge outlet (33) water travels toward discharge water line (8).

IX. Said lifted water, passes through pressure tapping (12), where it detects the pressure of water flow of discharge water line (8).

X. The pressure tapping (12) gives the pressure feedback to pressure regulating valve (6) that regulates pressure of the water flow; as per requirement, and set into pressure regulating valve (6). It will control the pressure of discharge water line (8).

XI. As the fire water header isolation valve (13) normally remains opened and utility water header isolation valve (14) normally remains closed; the pressure controlled flow in discharge water line (8) passes to fire water header (9), through non return valve (9*a*). Hence fire water header (9) gets filled by said water flow.

XII. The water in said fire water header (9), passes to plurality of water sprinkler header (10), through plurality of deluge valve (16).

XIII. Said plurality of deluge valve (16) being already opened by action II of control panel (4) as described earlier in step "II", water flow passes to plurality of sprinklers (18); which starts sprinkling of water, over fire caught area, detected by fire detection system (2).

XIV. If water is needed for other purposes like utility water for cleaning or testing of flow rate or regular maintenance etc., the utility water header (15) can be used by opening of utility water header isolation valve (14), and simultaneously closing fire water header isolation valve (13).

Referring to FIGS. 1B, 2B, 3B, 4, 5 & 7: with respect to embodiment HFREP (30A)

I. When fire take place in any area of platform, the fire detection system (2) transmit the fire signal, through First line for Fire signal transmission (2*a*), which is received by control panel (4).

II. Said fire signal is further transmitted to Second line for Fire signal transmission (11) of area where fire took place and open plurality of deluge valve (16).

III. The Control Panel (4) simultaneously sends signal to open blow down valve (5), provided in water inlet line (3), through instrument control line (5*a*).

IV. Said blow down valve (5) opened and allow water to flow, from water injection header (22), attached with plurality of water injection well (23); to the water inlet line (3); and enter through primary water inlet (31).

V. The pressure regulating valve (6) regulates the pressure of water flow and allows water flow to enter into nozzle (39 or 40) of HFREP (30A), which is placed below water surface level (19), into water body (20), which enters through primary water inlet (31).

VI. Simultaneously, feed water from water inlet line (3) enters into actuator (46) through pre-feed pressure tube (24) which is connected through drum inlet connection (44). Said feed water enters into the hydraulic drum (45) through drum inlet connection (44) and exerts pressure on cylinder mounted circular plate (42) by slipping over each other though Second stationary slip ring (48').

VII. The pressure on said cylinder mounted circular plate (42); move the said cylinder mounted circular plate (42) downward by slipping over each other though moveable slip ring (47); the nozzle also moves downward through inter connected plurality of second studs (36') with the cylinder mounted circular plate (42), as shown in the FIG. 3B. Hence, the space between nozzle and funnel (37) increase with the pressure. Similarly, if pressure of water inlet line (3) decreases; the pressure supplied in hydraulic drum (45) also decreases; the Second tension spring (43') inside the hydraulic drum (45) take action to pool nozzle (39 or 40) upward in same manner as discussed above and decrease the space between nozzle (39 or 40) and funnel (37). Thus said actuator (46); provides the function of controller that adjust the space between nozzle (39 or 40) and funnel (37) to achieve maximum ratio of water flow.

VIII. Said nozzle (39 or 40) converts water flow into high velocity water jet, which strike on area of water body (20); enclosed between conical area of funnel (37) and tip of nozzle (39 or 40).

IX. The impact of water jetting pushes the effected water (primary water and secondary water) inside said funnel (37) and directed towards mixing chamber (38). When water from water body (20) move toward mixing chamber (38) through said funnel (37) the low pressure generated in this area; creates water flow from water body (20) to mixing chamber (38), through secondary water inlet (32) and suction strainer (34); and starts water lifting from water body.

X. The lifted water in mixing chamber (38) along with primary water travels toward diffuser (35) and proceed to discharge outlet (33). Form said discharge outlet (33) water travels toward discharge water line (8).

XI. Lifted water passes through pressure tapping (12), where it detects the pressure of water flow in discharge water line (8).

XII. The pressure tapping (12), give the pressure feedback to pressure regulating valve (6) that regulates pressure of the water flow; that is in turn facilitated by the pressure tapping (12), as per requirement, and set into pressure regulating valve (6). It controls the pressure of discharge water line (8).

XIII. As the fire water header isolation valve (13) is normally remains opened, and utility water header isolation valve (14) is normally remain closed; the pressure controlled flow in discharge water line (8), passes to fire water header (9), through non-return valve (9*a*). Hence fire water header (9) is get filled by this water flow.

XIV. The water in said fire water header (9), passes to plurality of deluge valve (16), through plurality of water sprinkler header (10).

XV. Said plurality of deluges valve (16) being already opened by II action of control panel (4) as described earlier in step "II", water flow passes to plurality of sprinklers (18); sprinkling of water, starts over fire detected area, detected by fire detection system (2).

XVI. If water is needed for other purposes like utility water for cleaning or testing of flow rate or regular maintenance etc., the utility water header (15) can use by opening of utility water header isolation valve (14), and simultaneously closing fire water header isolation valve (13).

Referring to FIGS. 1B and 2B: with respect to embodiment HFREP (30) and another embodiment HFREP (30A)

When fire take place in any area of platform, the fire detection system (2) transmit the fire signal, through first line for fire signal transmission line (2*a*); which is received by control panel (4). Said fire signal is further transmitted to plurality of deluge valve (16) through second line for fire signal transmission (11). Simultaneously control Panel (4) send signal to open blow down valve (5) through instrument control line (5*a*) and allows water flow from water injection header (22), attached with plurality of water injection well (23).

Said pressure regulating valve (6) regulate the pressure of water flow and allows water flow to enter into nozzle (39 or 40 or 40') of HFREP (30 or 30A), which is placed below water surface level (19), into water body (20), through primary water inlet (31). Said primary water flow with reduced pressure and increased water flow discharges from the HFREP (30 or 30A) to fire water header (9) through non-return valve (9*a*), through discharge outlet (33) and discharge water line (8); and passes through pressure tapping (12) which gives the pressure feedback to pressure regulating valve (6). As the fire water header isolation valve (13) normally remains opened and utility water header isolation valve (14) normally remains closed; the pressure controlled flow in discharge water line (8) passes to fire water header (9), through non-return valve (9*a*). Hence fire water header (9) gets filled by this water flow. The water in said fire water header (9), passes to plurality of water sprinkler header (10), through plurality of deluge valve (16). Said plurality of deluge valve (16) passes water flow to plurality of sprinklers (18); starts sprinkling of water, over fire caught area, detected by fire detection system (2).

Inlet water flow from water inlet line (3) to the HFREP (30 or 30A), is known as primary flow and inlet water flow from water body (20) to HFREP (30 or 30A), is known as secondary flow. Whereas these both the flows mix together and travel towards fire water header (9) is known as generated flow or discharged flow. These generated flow is depends upon parameters, inlet flow rate $Q_p$, pressure of inlet flow $P_p$, flow ratio M (flow ratio of secondary flow rate to primary flow rate), secondary pressure $P_s$, discharge pressure (needed pressure) $P_d$, nozzle diameter $A_n$, efficiency $\eta$ and Pressure ratio $(N)=(P_5-P_2)/(P_1-P_5)$.

Where, $P_1$ is pressure of primary flow (also known as supply pressure), $P_2$ is pressure of secondary flow (also known as suction pressure), $P_5$ is pressure of mixed flow (also known as discharged pressure).

Example 1

The efficiency and flow ratio of High Flow Ratio Ejector Pump (HFREP) are depending upon parameters applied in the invented system. For example, 16 mm diameter of welded nozzle (39) or threaded nozzle (40), Or actuated nozzle (40') area ratio R is 0.1, primary water supply flow pressure 100 kg/cm2, secondary water inlet suction pressure 2 kg/cm2 and required desired pressure 11 kg/cm2, N will be 0.1, the flow ratio M will be 2.5, the efficiency observed is 0.25, with the resultant discharged flow rate 350 m3/hr.

This is better illustrated by graph shown in FIG. 8.

Illustration: the graph is plotted for area ratio R=0.1 (cross section area of nozzle (39 or 40 or 40') outlet at tip divided by cross sectional area of mixing chamber (38) it is clearly observed from the graph in FIG. 8, that flow ratio M (secondary flow or primary flow) is depends upon selected pressure ratio N (pressure difference of primary pressure & discharged pressure) divided by (difference of discharged pressure & secondary pressure), for Pressure ratio N=0.1; observed flow ratio is 2.5 and maximum efficiency will be 0.25, since this pump is used for fire-fighting where fire extinguishing much more important than efficiency, low efficiency is preferred for high flow ratio but cavitation problem can be solve by help of adjustment of space between nozzle (39 or 40 or 40') and funnel (37) (or mixing chamber (38)); that is adjusted manually in embodiment HFREP (30), whereas it is adjusted automatically in another embodiment HFREP (30A).

Example 2

The efficiency and flow ratio of High Flow Ratio Ejector Pump (HFREP) are depending upon parameters applied in the invented system. For example, 16 mm diameter of welded nozzle (39) or threaded nozzle (40), or actuated nozzle (40'), area ratio R is 0.06, primary water supply flow rate 100 m3/hr. at pressure 100 kg/cm2, secondary water inlet suction pressure 2 kg/cm2 and required desired pressure 8 kg/cm2, N will be 0.06, the flow ratio M will be 3.5, the efficiency observed is 0.25, with the resultant discharged flow rate 450 m3/hr.

This is better illustrated by graph shown in FIG. 9

Illustration: the graph is plotted for area ratio R=0.06 (cross section area of nozzle (39 or 40 or 40') outlet at tip/cross sectional area of mixing chamber (38)) it is clearly observed from the graph in FIG. 9, that flow ratio M (secondary flow divided by primary flow) is depends upon selected pressure ratio N (pressure difference of primary pressure & discharged pressure) divided by (difference of discharged pressure & secondary pressure), for Pressure ratio N=0.06; observed flow ratio is 3.5 and maximum efficiency will be 0.35, since this pump is used for firefighting where fire extinguishing much more important than efficiency, low efficiency is preferred for high flow ratio but cavitation problem is solved by help of adjustment of space between nozzle (39 or 40 or 40') and funnel (37) (or mixing chamber (38)). That is adjusted manually in embodiment HFREP (30), whereas it is adjusted automatically in another embodiment HFREP (30A).

Comparison of Prior Art and Present Invention

The typical prior art and the present invention are hereby compared in the below table to clearly bring out the technical differences between the prior art and the present invention.

A comparison is done between the prior art (traditional) ejector pumps and the submersible water lifting assembly of the present invention through the values of various parameters and its impact. This clearly depicts the disadvantages of the traditional systems; thereby establishing the need for the present invention.

TABLE 1

Comparative analysis of traditional ejector pumps with present submersible water lifting assembly, used in present automatic fire-fighting system.

| Sr. No. | Parameters | Prior Art of Ejector (Normal Range) | HFREP (30 or 30A) in present invention. (Normal range) | Disadvantages/ differences of prior arts over present invention |
|---|---|---|---|---|
| 1. | Supply/ Primary pressure. | 1 Kg/cm2 to 50 kg/cm2 | Not less than 50 kg/cm2 | Prior arts Can't generate high discharge flow which is most important for fire-fighting, at this supply pressure. The present invention is designed for high flow rate. |
| 2. | Secondary/ suction Pressure. | 0 to 2 kg/cm2 | Not less than 2 kg/cm2 | In prior arts cavity formation is possible if operated at high primary pressure, whereas this problem is solved in present invention. |
| 3. | Discharge Pressure. | 0 to 10 kg/cm2 | 0 to 15 kg/cm2 | Range of discharge pressure of HFREP is higher. |
| 4. | Primary Flow. | 1 m3/hr to 10 m3/hr | 100 m3/hr to 200 m3/hr | In prior arts, it is very small flow compared to present invention. So It is big disadvantage of prior arts, since it can't generate large discharge flow for fire-fighting. |
| 5. | Secondary Flow. | 1 m3/hr to 10 m3/hr | 200 m3/hr to 600 m3/hr | In prior arts, it is very small flow compared to present invention. So It is big disadvantage of prior arts, since it can't generate large discharge flow for fire-fighting. |
| 6. | Discharge flow | 2 m3/hr to 20 m3/hr | 300 m3/hr to 800 m3/hr | Biggest disadvantage of prior art is having very less discharge flow than the discharged flow of present invention. |

TABLE 1-continued

Comparative analysis of traditional ejector pumps with present submersible water lifting assembly, used in present automatic fire-fighting system.

| Sr. No. | Parameters | Prior Art of Ejector (Normal Range) | HFREP (30 or 30A) in present invention. (Normal range) | Disadvantages/ differences of prior arts over present invention |
|---|---|---|---|---|
| 7. | Flow Ratio. | Less the 1 | Greater than 2 | Serious disadvantage of prior art is having less flow ratio, compared to present invented system. |
| 8. | Primary Nozzle Diameter. | Less than 5 mm | Greater than 15 mm | Cannot generate as high flow as generated in present invention. |
| 9. | Primary Nozzle Spacing | Less than 5 mm | Greater than 15 mm | Possibility of cavity formation in prior arts if it used for high flow rate. Cavity problem is solved in present invention by providing flexibility to adjust space as needed for maximum flow ratio. |
| 10. | Mixing Chamber Diameter. | Less the 15 mm | Greater than 45 mm | Due to this, the capacity of flow in prior art is less than that of present invention. |
| 11. | Mixing Chamber Length | Less than 35 mm | Greater than 75 mm | Due to this, capacity of flow in prior art, is less than that of present invention. |
| 12. | Diffuser Diameter. | Less than 33 mm | Greater than 100 mm | Due to this, capacity of flow in prior art, is less than that of present invention. |
| 13. | Diffuser Length. | 66 mm to 77 mm | Greater than 200 mm | Due to this, capacity of flow in prior art, is less than that of present invention. |
| 14. | Variables Nozzle Spacing. | Generally not variable | Variable | Cannot adjust for maximum flow ratio in prior arts. Whereas, it can be done in present invention. |
| 15. | Flexibility for reversal of secondary Flow. | Not applicable. NRV is provided in most of ejector to stop reverse flow. | Provided for regular Strainer cleaning (Marine Growth Removal) | This is big disadvantage of prior arts as such facility is not applicable in it. Whereas this facility is provided in present invention to solve the problem of marine Growth. |
| 16. | Construction. | Generally all ejectors are mono assembly with three ports, 1, primary inlet, | Divided into two separate parts. These parts can be connected by long studs kept with some | The present invention has advantage over prior arts for adjustment of spacing for maximum flow |

TABLE 1-continued

| Comparative analysis of traditional ejector pumps with present submersible water lifting assembly, used in present automatic fire-fighting system. | | | | |
|---|---|---|---|---|
| Sr. No. | Parameters | Prior Art of Ejector (Normal Range) | HFREP (30 or 30A) in present invention. (Normal range) | Disadvantages/ differences of prior arts over present invention |
| | | 2, secondary water inlet and 3, common outlet. | space in between these two parts. This space works as secondary inlet. | ratio, which is most important for maximum available quantity of water for fire-fighting. |
| 17. | Noise pollution. | Generally all Ejectors Make high noise when works at high Differential pressure. | It doesn't make any noise because Large suction area is available for secondary flow. As it is designed for submerged condition into water; noise pollution is not possible. | Producing noise is disadvantage of prior arts. |

A further comparison is done between traditional fire-fighting system and the present automatic fire-fighting system having a submersible water lifting assembly. Table-2, Here in below shows a component wise distinction between the prior art (traditional) and the present invention.

TABLE 2

| Component wise differences of prior art and present invention. | | | | | |
|---|---|---|---|---|---|
| | | Prior art | | Present Invented system | |
| Sr. No. | Components | Is it part of system? | Disadvantage/ Problems/Draw backs of prior art | Is it part of System? | Advantages of present invention Over prior art |
| 1) | Fire Engine | Yes | Huge size diesel engine is used with gear box, air/gas start-up vessels etc<br>1. Needs space on platform.<br>2. Needs regular maintenance<br>3. Needs flues.<br>4. Needs lubricant<br>5. Needs fire proof exhaust line.<br>6. Needs complex star-up system.<br>7. Needs fuel tank.<br>8. Needs start-up air or gas storage vessel.<br>9. Large fire can damage and fuel storage tank. | No | HFREP is used in place of diesel engine or pump and it is located below sea level,<br>1. Doesn't require any space.<br>2. Doesn't require regular maintenance.<br>3. Doesn't require fuel, as it is powered by injection water flow.<br>4. Doesn't require lubricant.<br>5. Doesn't need fire proof exhaust,<br>6. Simple start-up system.<br>7. No need of fuel tank.<br>8. No need of start-up air or gas storage vessel.<br>9. Large fire can't damage system as HFREP is place below sea level |

TABLE 2-continued

Component wise differences of prior art and present invention.

| Sr. No. | Components | Prior art: Is it part of system? | Prior art: Disadvantage/ Problems/Draw backs of prior art | Present Invented system: Is it part of System? | Present Invented system: Advantages of present invention Over prior art |
|---|---|---|---|---|---|
| | | | 10. Needs fire protection wall | | 10. No need of fire protection wall as HFREP is placed below sea level. |
| 2) | Gear Box Assembly | Yes | As there is gear box in the system.<br>1. Needs maintenance<br>2. Chances of failure | No | As, there is no gear box in the system.<br>1. No need of maintenance<br>2. No Chance of failure. |
| 3) | Pump Column shaft between gear box and pump | Yes | As, there are Pump Column and shaft in the system.<br>1. Difficult to lift these items at deck level, for pump maintenance<br>2. Increases the cost of fire-fighting system | No | As, there is no Pump Column and shaft in the system.<br>1. Eliminates maintenance.<br>2. Decreases the cost of fire-fighting system. |
| 4) | Multi stage centrifugal pump assembly | Yes | As there is multi stage centrifugal pump assembly in the system<br>1. Difficult to lift pump for maintenance<br>2. Increases the cost of fire-fighting system | No | As there is no multi stage centrifugal pump assembly in the system<br>1. Eliminates maintenance.<br>2. Decreases the cost of fire-fighting system. |
| 5) | Fire water pump column casing | Yes | Increases the cost of fire-fighting system | no | As there is no column casing needed, it reduces the cost of fire-fighting system. |
| 6) | Fire Engine exhaust line | Yes | As there is no fire Engine in the system,<br>1. Increases the cost of fire-fighting system<br>2. Increase the risk of fire hazard. | No | As there is no fire Engine in the system,<br>1. Reduces the cost of fire-fighting system<br>2. Reduces the risk of fire hazard |
| 7) | Startup air or gas storage vessel | Yes | Since there is fire Engine in the system, startup air or gas vessel is needed<br>1. Occupy lot of space on the platform.<br>2. Increases the cost of firefighting system<br>3. Needs charging/ filling of air/gas mechanism. Like start up air compressor/ gas pressure regulating mechanism. | No | Since there is no fire Engine in the system, start-up air or gas vessel is not needed<br>1. Doesn't occupy any space on the platform<br>2. Reduces cost of fire-fighting system.<br>3. Doesn't needs charging/filling of air/gas mechanism. |
| 8) | Diesel storage vessel | Yes | As fuel is used in the system, storage vessel is needed.<br>1. Occupy lot of space on the platform | No | As fuel is not used in the system, storage vessel is not needed.<br>1. Doesn't occupy any space on the platform. |

TABLE 2-continued

Component wise differences of prior art and present invention.

| Sr. No. | Components | Prior art: Is it part of system? | Prior art: Disadvantage/ Problems/Draw backs of prior art | Present Invented system: Is it part of System? | Present Invented system: Advantages of present invention Over prior art |
|---|---|---|---|---|---|
| | | | 2. Increases the cost of fire-fighting System | | 2. So, reduces the cost of fire-fighting system |
| 9) | Fire water overboard line | Yes | Main assembly fire engine is placed on platform, water flow must be regulated as per requirement, which needs over board line.<br>1. Increase capital cost due to expensive construction material, Cu—Ni<br>2. Needs pressure relief valve to regulate line pressure and safe guard the system itself.<br>3. Noise and vibration of overboard line | No | Main assembly HFREP is submerged in water, and water flow is regulated as per requirement, as well as, pressure relief is inbuilt facility in this invented unit,<br>1. It don't require over board line.<br>2. Saves the material cost of Cu—Ni use in over board line.<br>3. Reduces the noise and vibration of platform structure. |
| 10) | Suction Strainer | Yes | Problem of Marine Growth which can stop/restrict flow of water | yes | Since, reverse flow of water at higher pressure is possible in this system, marine growth can be removed easily any time. Only 5 minutes running of reverse flow per month, is sufficient to prevent marine growth at suction Strainer. |
| 11) | Diesel storage tank | Yes | There is a Fire risk as it is mounted on fire engine and there is limited area in unmanned platform to locate the engine. | No | As fuel is not used in the system, storage tank is not needed.<br>So, reduces the risk of fire hazard on system itself. |
| 12) | Water injection header | No | Not applicable. | Yes | Water injection header is main source of energy for working of present invention.<br>Utilization of stored energy in this header is most advantage of present invention. |
| 13) | Pressure Relief valve | Yes | As fire engine rotates with fixed RPM, needed to maintain require pressure in fire water header. | No | As, header pressure is automatically maintain in the system, there no need of this pressure relief valve. |

TABLE 2-continued

| Component wise differences of prior art and present invention. | | | | | |
|---|---|---|---|---|---|
| | | Prior art | | Present Invented system | |
| Sr. No. | Components | Is it part of system? | Disadvantage/ Problems/Draw backs of prior art | Is it part of System? | Advantages of present invention Over prior art |
| | | | 1. High noise pollution.<br>2. High vibration of over board line | | 1. No noise pollution.<br>2. No high vibration. |
| 14) | HFREP | No | Not applicable | Yes | Since, Main unit HFREP is located at subsea level,<br>1. No noise pollution.<br>2. No ice formation.<br>3. No vibration.<br>4. No need of pressure relief valve.<br>5. No need of pump casing<br>6. No marine growth problem.<br>7. No lubricant required.<br>8. No fuel consumption.<br>9. No frequent brake down of system.<br>10. Repair/ maintenance job is very simple & easy. |

Advantages of the Invention

1. Present automatic fire-fighting system for offshore platform that is efficient yet simple to install, energy saving, noise free, and economical.
2. Present automatic fire-fighting system for offshore platforms utilizes high pressure water from the water injection system at offshore that is already present at offshore of oil and gas industries. This water provides the high pressure as energy source as well as water source. This eliminates the requirement of any additional system for providing pressure or energy. This also eliminates the requirement of fuel.
3. The pressure of water is used as source of energy while lifting additional water from the water body (sea; in case of oil and gas offshore platforms) to be sprinkled for fire-fighting. This enables the working of the system even in absence of fuel engine driven pump or electricity; unlike the prior arts. This makes the system energy efficient and economical. Besides, it is especially useful in cases of large fire of any type; when providing electricity for running water pumps is not feasible or advisable. It enhances its applicability at places where there is no electric connections or has limited electricity availability. So, there is no fuel consumption.
4. The mechanism of water lifting described in the present invention enables discharge of water with very high flow rate enabling water lifting to desired height for sprinkling it on fire. The discharged flow rate is in multiple of supplied flow rate. The present invented system (1) enables conversion of flow rate as well as achieving desired pressure for proper handling and requisite use; that can serve the purpose of present invention.
5. Present automatic fire-fighting system for offshore platforms that is self-cleaning and hence auto-maintenance.
6. Installation of present invented system (1) is possible by simple modification in existing offshore platform arrangement. This eliminates installation of additional multi-part arrangements thereby reduces the complexity in construction and operation. This also makes the present invention maintenance free. Moreover, it requires minimum space for installation.
7. Present invention eliminates risk of fire on main equipment of fire-fighting system itself. This is because the main equipment i.e. the HFREP remains submerged in water.
8. There are no rotating parts in the invented system, so, lubrication needed in Invented system. Thus, there is almost nil maintenance required for the system.
9. It ensures safeguard from fire; particularly to the unmanned platform and reduces the premium of insurance.
10. Present invented system (1) enables additional utility for using water for cleaning etc.
11. There is no noise pollution by the present invention unlike the prior arts (traditional arts).
12. Present invented system (1) is easy to operate and safe.
13. It is a system of lowest capital cost.
14. There is no operational cost in present invented system (1), as it does not use any fuel and it is automatic operation which does not require manpower to operate it.
15. Marine growth removal becomes easy by reversing secondary flow.
16. Over board line with pressure relief mechanism, constructed from high cost metal Cu—Ni (metal alloy, constructed by combination of copper and nickel) is not require in presently invented System. It saves the cost.

Applicability of Present Invention

The Submersible water lifting system and the automatic Fire-Fighting System having the same assembly, has its main applicability in Oil and Gas Industry at offshore platforms particularly at unmanned platforms where electricity, fire engines and regular human presence are not available but high pressure water flow is available.

It can also be used at onshore to lift water for fire-fighting, from low level ponds provided that high pressure water flow is available by any means like water injection lines, tanker having high pressure pump.

Though present invented system (1) is mainly designed for emergency fire-fighting operations, it can also use as a utility or service water pump in all onshore and offshore installations where high pressure water flow is available. It can also be used in marine applications like stripping of blast tanks and sewage treatment plants etc. in ships.

There are varies applications of the present invented system (1); which includes, but not limited to the applications listed herein below. The system as a whole or part of system can also be used in below mentioned industries.

1. Pumping of slurries.
2. Pumping fire water, where electrically driven pumps present an explosion risk.
3. Draining and dewatering with little modification in the system.
4. Blending and proportioning.
5. Flare gas recovery in Oil & Gas Industry.
6. Dozing of Chemicals, in process Industries.
7. Artificial lifting of Oil, in Oil & Gas Industry.
8. Deep water well pumping/domestic water supply.
9. For solid transfer.
10. As a vacuum pump.
11. As a thrust augmenters for dynamic positioning of ships.
12. It can be used to elevate low level water to medium level by utilising high elevated water.

The invention claimed is:

1. A submersible water lifting system for automatic fire-fighting system at unmanned platforms having said submersible water lifting system (1) wherein said submersible water lifting system is a High Flow Ratio Ejector Pump (HFREP) (30), and comprises:

Fire detection system (2),
First line for Fire signal transmission (2*a*),
Water inlet line (3),
Control Panel (4),
Blow down Valve (5),
Instrument control line (5*a*),
Pressure Regulating Valve (6),
High Flow Ratio Ejector Pump (30),
discharge water line (8),
fire water header (9),
Non Return Valve (9*a*),
Plurality of water sprinkler header (10),
First water sprinkler header (10*a*),
Second water sprinkler header (10*b*),
Second line for Fire signal transmission (11),
Pressure tapping (12),
Fire water header isolation valve (13),
Utility water header isolation valve (14),
Utility water header (15),
Plurality of deluge valve (16),
First Deluge valve (16A),
Second Deluge valve (16B),
Plurality of Sprinklers (18),
Water surface level (19),
Water body (20) [sea],
Supply pressure line (21),
Water injection header (22),
Plurality of Water Injection Wells (23), and
Pre-feed Pressure tube (24),
Wherein the High Flow Ratio Ejector Pump (30) comprises:
Primary water inlet (31),
Secondary water inlet (32),
Discharge outlet (33),
Suction Strainer (34),
Diffuser (35),
Plurality of first studs (36),
Funnel (37),
Mixing chamber (38),
Welded Nozzle (39),
Threaded Nozzle (40),
Actuated nozzle (40'),
Plurality of bolts & nuts (41),
First tension spring (43),
First movable slip ring (47),
First stationary slip ring (48),
Communicating hole (49),
Nozzle mounted hydraulic drum (50),
Cylindrical pedestal (51), Wherein the water inlet line (3) is connected with water injection header (22) to provide for pressurized water to the submersible water lifting system (1), same way as plurality of water injection wells (23) is connected; the inflow water from the water inlet line (3) is controlled by pressure regulating valve (6) and regulates pressure of the water flow; the first line for fire signal transmission (2*a*) transmit fire signal from fire detection system (2) to control panel (4) and further transmits from control panel (4) to plurality of deluge valve (16) through second line for fire signal transmission (11) to open first deluge valve (16A) or second deluge valve (16B) or both or more as per fire caught area; said control panel (4) is powered by water pressure taken from water inlet line (3) through supply pressure line (21) or alternatively powered by pneumatic/electric power; similarly, pre-feed pressure tube (24) is also tapped from water inlet line (3) for controlled operation of the HFREP (30); said control panel (4) opens blow down valve (5) provided in water inlet line (3), through instrument control line (5*a*); and permits pressurised water to enter the submersible water lifting system (1) through primary water inlet (31); the inflow of water from the water inlet line (3) is controlled by pressure regulating valve (6) provided in water inlet line (3), with the help of feedback pressure from pressure tapping (12), provided in discharge water line (8); the submersible water lifting system receives high pressure water from the water inlet line (3) through its primary water inlet (31) to utilize the energy of the same and create the suction within the HFREP (30) to suck more water from the water body (20) through its secondary water inlet (32) and thereby reduce the pressure of the primary water flow and increase the amount of the water to be flowing within the submersible water lifting system; without use of any external source of energy; the primary water flow with reduced pressure and increased water flow discharges from the HFREP (30) to fire water header (9) through non-return valve (9*a*), through discharge outlet (33) and discharge water line (8); wherein non-Return Valve (9*a*) are provided to facilitate single side flow of water for fire-fighting; the suction strainer (34) is provided on the secondary water inlet (32) to avoid the entry of marine substances; further plurality of water sprinkler header (10) sprinkle water through plurality of sprinklers (18); once it receives said mixture of water; amongst which, a first water sprinkler header (10*a*) is provided to sprinkle water in upper deck and a second water sprinkler header (10*b*) is provided to sprinkle water in lower deck area; the plurality of deluge valve (16) [first deluge valve (16A), second deluge valve (16B)] is provided for directing the water flow in area of fire; said control panel (4) is powered by water pressure taken from water inlet line (3) through supply pressure line (21); in addition, Utility Water isolation Valve (14) manually opens and fire water isolation valve (13) manually closes for directing the water flow to utility water header (15) for utility purposes including cleaning;

Wherein said HFREP (30) receive high pressure primary flow of water from the water inlet line (3), through its primary water inlet (31) to utilize the energy of the flow of water and create the suction within the HFREP (30) generating secondary flow; to suck additional water from the water body (20) through its secondary water inlet (32); said welded nozzle (39) is attached to primary inlet (31) facilitates primary water to enter the HFREP (30) from said primary inlet (31); or a threaded nozzle (40) is used where adjusting height of the threaded nozzle (40) is required; or an actuated nozzle (40') is used for adjusting the height of the actuated nozzle (40') in increased or decreased pressure of primary flow; wherein the water enters into the enclosed space between said hydraulic drum (50) and cylindrical pedestal (51) through communicating hole (49) and exert more pressure inside this enclosed space, thus volume of this enclosure expands; whereas the actuated nozzle (40') mounted on hydraulic drum (50) move downward by sliding over first movable slip ring (47) and first stationary slip ring (48) which increases space between mixing chamber (38) & tip of the actuated nozzle (40'); and the pressure of primary flow decreases the first tension spring (43) reduces the space between tip of the actuated nozzle (40') and mixing chamber (38); the high flow of water induces low pressure zone in an area surrounding a tip of said welded nozzle (39) or threaded nozzle (40) or the tip of said actuated nozzle (40') which in turn results in flow of water from water body (20) to the HFREP (30); said flow is the secondary flow of water into the HFREP (30) and the area surrounding the welded nozzle, the threaded nozzle or the actuated nozzle (39 or 40 or 40') from where the flow enters, forms the secondary inlet (32);

Said suction strainer is provided to allow only strained water to enter from the secondary inlet (32) thereby preventing entry of marine substances and in turn chocking of the HFREP (30); said funnel (37) is placed at a pre-fixed distance above the welded nozzle, the threaded nozzle or the actuated nozzle (39 or 40 or 40') by attaching the flange of the funnel (37) with the flange of the welded nozzle, the threaded nozzle or the actuated nozzle (39 or 40 or 40') using plurality of first studs (36) by plurality of bolts & nuts (41); wherein said funnel (37) is provided to collect the secondary flow from water body (20) as well as primary flow from primary water inlet line (31) and direct it towards the mixing chamber (38); Said pre-fixed distance is manually adjustable to achieve desired distance between the tip of the welded nozzle, the threaded nozzle or the actuated nozzle (39 or 40 or 40') and funnel (37) for maximum discharge flow as provided by primary flow; said plurality of first studs (36) maintains said pre-fixed distance and provides support to said strainer (34) and attached as well as fixed with flange of funnel (37), by plurality of bolts & nuts (41); said mixing chamber (38) follows the funnel (37); wherein primary and secondary flow of water enters and energy transformation takes place between said two flows for maximum recovery of pressure energy, from the primary flow; diffuser (35) follows said mixing chamber (38) receives the mixture of two water flows (primary flow and secondary flow) to achieve maximum pressure in it; said discharge outlet (33) receive the water from said diffuser (35) and passes to discharge water line (8).

2. An automatic fire-fighting system for unmanned platforms having submersible water lifting system as claimed in claim 1, enabling automatic cleaning of suction strainer, wherein:

said fire water header isolation valve and utility water header isolation valve are closed for purpose of automatic cleaning, which facilitates water discharge from secondary water inlet into the water body (sea), thereby enabling cleaning of the suction strainer, further ensuring there is no blockage by marine substances and allows ready infusion of water through secondary water inlet.

3. A submersible water lifting system as claimed in claim 1, wherein:

the submersible water lifting system is placed under water body (20) below water surface level (19) for operational advantages and self-defense from fire.

4. A submersible water lifting system for automatic fire-fighting system at unmanned platforms having said submersible water lifting system (1) wherein said submersible water lifting system is a High Flow Ratio Ejector Pump (HFREP) (30A), and comprises:

Fire detection system (2),
First line for Fire signal transmission (2*a*),
Water inlet line (3),
Control Panel (4),
Blow down Valve (5),
Instrument control line (5*a*),
Pressure Regulating Valve (6),
High Flow Ratio Ejector Pump (30A),
discharge water line (8),
fire water header (9),
Non Return Valve (9*a*),
Plurality of water sprinkler header (10),
First water sprinkler header (10*a*),
Second water sprinkler header (10*b*),
Second line for Fire signal transmission (11),
Pressure tapping (12),
Fire water header isolation valve (13),
Utility water header isolation valve (14),
Utility water header (15),
Plurality of deluge valve (16),
First Deluge valve (16A),
Second Deluge valve (16B),
Plurality of Sprinklers (18),
Water surface level (19),
Water body (20) [sea],
Supply pressure line (21),
Water injection header (22), Plurality of Water Injection Wells (23), and
Pre-feed Pressure tube (24), Wherein, the High Flow Ratio Ejector Pump (30A) comprises:

Primary water inlet (31),
Secondary water inlet (32),
Discharge outlet (33),
Suction Strainer (34),
Diffuser (35),
Plurality of second studs (36'),
Funnel (37),
Mixing chamber (38),
Welded Nozzle (39),
Threaded Nozzle (40),
Plurality of bolts & nuts (41),
Cylinder mounted circular plate (42),
Second tension spring (43'),
Drum Inlet connection (44),
Hydraulic drum (45),
Actuator (46),
Second movable slip ring (47'),
Second stationary slip ring (48'), Wherein; the water inlet line (3) is connected with water injection header (22) to provide for pressurized water to the submersible water lifting system (1), same way as plurality of water injection wells (23) is connected; the inflow water from the water inlet line (3) is controlled by pressure regulating valve (6) and regulates pressure of the water flow; the first line for fire signal transmission (2*a*) transmit fire signal from fire detection system (2) to control panel (4) and further transmits from control panel (4) to plurality of deluge valve (16) through second line for fire signal transmission (11) to open first deluge valve (16A) or second deluge valve (16B) or both or more as per fire caught area; said control panel (4) is powered by water pressure taken from water inlet line (3) through supply pressure line (21) or alternatively powered by pneumatic/electric power; similarly, pre-feed pressure tube (24) is also tapped from water inlet line (3) for controlled operation of the HFREP (30A); said control panel (4) opens blow down valve (5) provided in water inlet line (3), through instrument control line (5*a*); and permits pressurised water to enter the submersible water lifting system (1) through primary water inlet (31); the inflow of water from the water inlet line (3) is controlled by pressure regulating valve (6) provided in water inlet line (3), with the help of feedback pressure from pressure tapping (12), provided in discharge water line (8); the submersible water lifting system receives high pressure water from the water inlet line (3) through its primary water inlet (31) to utilize the energy of the same and create the suction within the HFREP (30A) to suck more water from the water body (20) through its secondary water inlet (32) and thereby reduce the pressure of the primary water flow and increase the amount of the water to be flowing within the submersible water lifting system; without use of any external source of energy; the primary water flow with reduced pressure and increased water flow discharges from the HFREP (30A) to fire water header (9) through non-return valve (9*a*), through discharge outlet (33) and discharge water line (8); wherein non-Return Valve (9*a*) are provided to facilitate single side flow of water for fire-fighting; the suction strainer (34) is provided on the secondary water inlet (32) to avoid the entry of marine substances; further plurality of water sprinkler header (10) sprinkle water through plurality of sprinklers (18); once it receives said mixture of water; amongst which, a first water sprinkler header (10*a*) is provided to sprinkle water in upper deck and a second water sprinkler header (10*b*) is provided to sprinkle water in lower deck area; the plurality of deluge valve (16) [first deluge valve (16A), second deluge valve (16B)] is provided for directing the water flow in area of fire; said control panel (4) is powered by water pressure taken from water inlet line (3) through supply pressure line (21); in addition, Utility Water isolation Valve (14) manually opens and fire water isolation valve (13) manually closes for directing the water flow to utility water header (15) for utility purposes including cleaning;

Wherein, said HFREP (30A) receive high pressure primary flow of water from the water inlet line (3), through its primary water inlet (31) to utilize the energy of the flow of water and create the suction within the HFREP (30A) generating secondary flow; to suck additional water from the water body (20) through its secondary water inlet (32); said welded nozzle (39) is attached to primary inlet (31) facilitates primary water to enter the HFREP (30A) from said primary inlet (31); or a threaded nozzle (40) is used where adjusting height of the threaded nozzle (40) is required; the high flow of water induces low pressure zone in an area surrounding a tip of said welded nozzle (39) or threaded nozzle (40) which in turn results in flow of water from water body (20) to the HFREP (30A); said flow is the secondary flow of water into the HFREP (30A) and the area surrounding the welded nozzle or the threaded nozzle (39 or 40) from where the flow enters, forms the secondary inlet (32);

said suction strainer (34) allows only strained water to enter from the secondary inlet (32) for preventing entry of marine substances and in turn chocking of the HFREP (30A); said funnel (37) is placed at a pre-fixed distance above the welded nozzle or the threaded nozzle (39 or 40) by attaching the flange of the funnel (37) with the flange of the welded nozzle or the threaded nozzle (39 or 40) using plurality of second studs (36') by plurality of bolts & nuts (41); said pre-fixed distance is manually adjustable to achieve desired distance between the tip of the welded nozzle or the threaded nozzle (39 or 40) and funnel (37) for maximum discharge flow as per provided primary flow and secondary flow to direct it towards the mixing chamber (38); the plurality of second studs (36') maintains fixed distance and provides support to said strainer (34) and top ends of the studs (36') which are fixed with cylinder mounted circular plate (42); the flange of funnel (37) is not fixed with the plurality of second stud (36') but allow to slip through holes in the flange thus said funnel (37) is free to move; said mixing chamber (38) allows water entry of primary and secondary flow, where energy transformation takes place for maximum recovery of pressure energy, from the primary flow; said diffuser (35) receives the mixture of water flow from mixing chamber (38) to achieve maximum pressure in it; said discharge outlet (33) receive the water and passes to discharge water line (8); said plurality of bolts & nuts (41) fixed the suction strainer (34) with flange of the welded nozzle or the threaded nozzle (39 or 40); the actuator (46) is to adjust space between the welded nozzle or the threaded nozzle (39 or 40) and mixing chamber (38);

said actuator (46) is provided for resolving the pressure fluctuations in primary flow in order to achieve maximum discharge flow; Said actuator (46) is connected to flange of the welded nozzle or the threaded nozzle (39 or 40) through plurality of second studs (36') such that cylinder mounted circular plate (42) of the actuator is attached to the mixing chamber (38) by second movable slip ring (47') and second stationary slip ring (48'); and is further attached to the water inlet line (3) through a pre-feed pressure tube (24) to receive pressurised water from water inlet line (3) in its hydraulic drum (45) through drum inlet connection (44); said drum inlet connection (44) facilitates the pressure tubing connection between water inlet line (3) and hydraulic drum (45); the received pressure of primary flow of water from water inlet line (3) exerts pressure on cylinder mounted circular plate (42); Said hydraulic drum (45) provides mounting of second tension spring (43') and facilitates holding of the hydraulic pressure received from primary flow through drum inlet connection (44); Said second moveable slip ring (47') and second stationary slip ring (48') provides slipping between mixing chamber (38) and cylinder mounted circular plate (42), as well as hydraulic drum (45) and cylinder mounted circular plate (42); said second tension spring (43') is provided to restore the position of funnel (37) and the welded nozzle or the threaded nozzle (39 or 40) tip.

5. A submersible water lifting system as claimed in claim 4, wherein:

the submersible water lifting system is placed under water body below water surface level for operational advantages and self-defense from fire.

6. An automatic fire-fighting system for unmanned platforms having submersible water lifting system as claimed in claim 4, enabling automatic cleaning of suction strainer, wherein:

said fire water header isolation valve and utility water header isolation valve are both closed for purpose of automatic cleaning, which facilitates water discharge from secondary water inlet into the water body (sea), thereby enabling cleaning of the suction strainer, further ensuring there is no blockage by marine substances and allows ready infusion of water through secondary water inlet.

* * * * *